US006250126B1

(12) United States Patent
Yasuda et al.

(10) Patent No.: US 6,250,126 B1
(45) Date of Patent: Jun. 26, 2001

(54) PLATE ROLLING MILL

(75) Inventors: Kenichi Yasuda, Hitachinaka; Mitsuo Nihei, Hitachi; Yukio Hirama, Mito; Yoshio Takakura, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/323,028

(22) Filed: Jun. 1, 1999

(30) Foreign Application Priority Data

Jun. 2, 1998 (JP) ..... 10-153347

(51) Int. Cl.[7] ..... B21B 13/14; B21B 31/07

(52) U.S. Cl. ..... 72/241.2; 72/240

(58) Field of Search ..... 72/240, 241.2, 72/241.4, 241.6, 241.8, 243.2, 243.4, 243.6, 248, 252.5

(56) References Cited

U.S. PATENT DOCUMENTS 4,212,504 * 7/1980 Krylov et al. ..... 72/241.8
4,481,799 * 11/1984 Glattfelder et al. ..... 72/241.8
4,502,312 * 3/1985 Marchioro ..... 72/243.2
5,308,307 * 5/1994 Morel et al. ..... 72/241.6
5,495,798 * 3/1996 Niskanen et al. ..... 72/245

FOREIGN PATENT DOCUMENTS 6018206 1/1985 (JP) .
2147108 6/1990 (JP) .

* cited by examiner

*Primary Examiner*—Rodney A. Butler
(74) *Attorney, Agent, or Firm*—Evenson, McKeown, Edwards & Lenahan, P.L.L.C.

(57) ABSTRACT

The invention intends to always maintain a distance between a hydrostatic pressure bearing and a roll even in a transient state before and after the start of rolling, thereby sufficiently and surely preventing damage of those components upon contact with each other, and to prevent a lowering of yield. In a plate rolling mill comprising upper and lower work rolls, and hydrostatic pressure bearings for supporting barrel portions of idler rolls in a non-contact manner with fluid pressure substantially along the horizontal direction, the idler rolls supporting the work rolls substantially along the horizontal direction, gap restraining rolls are provided to prevent gaps between the hydrostatic pressure bearings and the idler rolls from becoming lower than a predetermined value.

22 Claims, 26 Drawing Sheets

PLATE ROLLING MILL

BACKGROUND OF THE INVENTION

1. Field of the Invention

The present invention relates to a rolling mill for rolling a plate, and more particularly to a plate rolling mill using work rolls of small diameters and suitable for rolling a hard or ultra-thin strip.

2. Description of the Related Art

In such a rolling mill, using work rolls of smaller diameters provides a larger rolling limit (i.e., enables a plate to be rolled more thinly). For that reason, work rolls of small diameters have been heretofore used for rolling a hard or ultra-thin strip of, e.g., stainless steel. With a decrease in diameter of the work rolls, however, the torsional strength of the rolls themselves lowers inevitably, and a torque required for rolling cannot be applied to the work rolls in some cases. It is hence general that when using work rolls of small diameters, other rolls (for example, intermediate rolls) than the work rolls are rendered to operate as drive rolls.

In the above mill structure, the work rolls are each subjected during the rolling operation to a driving tangential force from an roll (for example, an intermediate roll) contacting with the work roll, and a front tension and a back tension from a plate under rolling. These force and tensions are all forces acting on the work roll in the horizontal direction (referred to as horizontal forces hereinafter). On the other hand, the smaller the diameter of the work roll, the smaller is the bending rigidity of the roll itself. Accordingly, the work roll undergoes deflection in a horizontal plane due to the horizontal forces.

The horizontal deflection causes a more marked disturbance in shape (flatness) of a plate under rolling. Also, when upper and lower work rolls deflect in opposite directions (one deflecting toward the incoming side and the other deflecting toward the outgoing side), central portions of upper and lower work rolls are subjected to forces acting in directions away from each other, thus accelerating the deflections of the work rolls in the opposite directions. In that case, if an excessively large rolling load is applied, it would be hard to surely prevent breakage of the rolls. The rolling load cannot be therefore so increased.

To cope with the problem mentioned above, there have been developed cluster-mill type rolling mills, including a Sendzimir mill, as well as a rolling mill provided with a horizontal deflection preventing mechanism wherein barrel portions of work rolls are supported horizontally by support rolls, as disclosed in JP,A,60-18206, for example. In these rolling mills, however, since the support roll is divided in the direction of length of the roll barrel, another problem occurs in that the surface properties of the plate being deteriorate due to mark transfer made by the divided support rolls.

For solving the above problem, JP,A,2-147108, for example, discloses a rolling mill wherein barrel portions of work rolls are supported horizontally by not-divided support rolls, and barrel portions of the support rolls are supported by hydrostatic pressure bearings, thereby suppressing deflections of the work rolls.

SUMMARY OF THE INVENTION

However, the rolling mill disclosed in JP,A,2-147108 accompanies the following problems.

In the disclosed rolling mill, rolling of a sheet is usually started with procedures below.

(1) A sheet to be rolled is threaded between the work rolls which are in a state moved away from the pass line (thereafter the sheet is held standstill);

(2) The work rolls are tightened to press the sheet under a predetermined load;

(3) A front tension and a back tension are applied to the sheet; and (4) Intermediate rolls are rotated to drive the work rolls to start the rolling of the sheet.

As is apparent from the above procedures (1) to (4), in the state immediately before the start of the rolling (step (4)), a driving tangential force does not yet act on the work roll. At the same time as when the rolling starts, the driving tangential force generates and acts on the work roll abruptly. Because the rolling operation begins in such a discontinuous condition, a force tending to deflect the work roll to a larger extent generates transiently and a horizontal force imposed on the hydrostatic pressure bearing increases immediately after the start of the rolling.

With the hydrostatic pressure bearing constructed so as to float the work roll under hydrostatic pressure of a fluid (e.g., oil) and support it in a non-contact manner, the amount of floating of the roll (i.e., the gap between the roll and the hydrostatic pressure bearing) is momentarily reduced upon the generation of the above transient horizontal force. Also, at the moment when the roll starts rotating, the tensions etc. are apt to be unstable. For these reasons, it is hard to surely prevent the roll and the hydrostatic pressure bearing from being damaged upon contact with each other.

If the roll is damaged, a resulting scratch on the roll would be transferred to the surface of a sheet being rolled, and the rolled sheet would be a failed product. Therefore, the damaged roll and hydrostatic pressure bearing must be totally replaced. This may raise problems of reducing productivity and lowering yield.

As a method for avoiding the above problems, it is conceivable to apply a smaller initial tightening load to reduce a force imposed on the hydrostatic pressure bearing, and then to further tighten the roll to a predetermined load after the roll has rotated. With this method, however, a problem still remains in that the rolled sheet does not have a predetermined thickness immediately after the start of the rolling, and hence yield lowers.

Another conceivable method is to employ a resilient means, such as a spring, to adjust the distance between the roll and the hydrostatic pressure bearing as disclosed in JP,A,61-193704, for example. However, a resilient means has such a property that as an applied force increases, the resilient means deforms to a large extent. Accordingly, the provision of the resilient means is not sufficient to always maintain the distance between the roll and the hydrostatic pressure bearing to be not smaller than a certain value, and to surely prevent the roll and the hydrostatic pressure bearing from being damaged upon contact with each other.

With the view of solving the above problems in the related art, an object of the present invention is to provide a plate rolling mill which can always maintain a distance between a roll and a hydrostatic pressure bearing even in a transient state before and after the start of rolling, thereby sufficiently and surely preventing damage of those components upon contact with each other, and which can avoid a lowering of yield.

(1) To achieve the above object, according to the present invention, in a plate rolling mill comprising upper and lower work rolls, and hydrostatic pressure bearings for supporting barrel portions of the work rolls or barrel portions of support rolls in a non-contact manner with fluid pressure substantially along the horizontal direction, the support rolls supporting the work rolls substantially along the horizontal direction, the plate rolling mill further comprises stopper means for preventing gaps between the hydrostatic pressure bearings and the work rolls or the support rolls supported by the hydrostatic pressure bearings from becoming lower than a predetermined value.

With the above features, even when a force tending to deflect the work roll to a larger extent generates transiently immediately after the start of rolling to increase a horizontal force exerted on the hydrostatic pressure bearing supporting the work roll (or the support roll supporting it), and the gap between the hydrostatic pressure bearing and the roll (i.e., the amount of floating of the roll) is going to momentarily reduce, the gap can be prevented from becoming lower than the predetermined value. Accordingly, the gaps between the hydrostatic pressure bearings and the work rolls (or the support rolls) can be always maintained to be not smaller than the predetermined value. It is hence possible to sufficiently and surely prevent those components from being damaged upon contact with each other, and to avoid a lowering of yield.

(2) In the above (1), preferably, the stopper means are roller means provided in contact with the work rolls or the support rolls substantially in the horizontal direction.

(3) In the above (2), preferably, the hydrostatic pressure bearings support the barrel portions of the support rolls in a non-contact manner, and the roller means are provided in contact with the work rolls substantially in the horizontal direction.

(4) In the above (2), preferably, the hydrostatic pressure bearings support the barrel portions of the work rolls in a non-contact manner, and the roller means are provided in contact with the work rolls substantially in the horizontal direction.

(5) In the above (2), preferably, the hydrostatic pressure bearings support the barrel portions of the support rolls in a non-contact manner, and the roller means are provided in contact with the support rolls substantially in the horizontal direction.

(6) In the above (5), preferably, each of the support rolls includes a first support roll in direct contact with corresponding one of the work rolls for supporting the same substantially along the horizontal direction, and second support rolls in contact with the first support roll for supporting the same at plural points in the vertical direction, each of the hydrostatic pressure bearings supports the barrel portions of the second support rolls in a non-contact manner, and each of the roller means is provided in contact with the first support roll substantially in the horizontal direction.

(7) In the above (2), preferably, each of the roller means is provided in contact with corresponding one of the work rolls or the support rolls at plural points in the vertical direction.

(8) In the above (2), preferably, the roller means are fixed to beams to which the hydrostatic pressure bearings are connected.

(9) In the above (2), preferably, the roller means are connected to a housing of the plate rolling mill, and the plate rolling mill further comprises roller advancing/-retracting means for moving the roller means back and forth with respect to the housing.

(10) In the above (1), preferably, the stopper means are block members fixed to the hydrostatic pressure bearings so as to project toward the work rolls or the support rolls.

(11) In the above (2) or (10), preferably, the roller means or the block members are in contact with the work rolls or the support rolls at positions axially outside an area corresponding to a maximum width of plates to be rolled.

With the above features, the surface properties of the rolled plate can be kept from deteriorating due to mark transfer made upon contact between the rolls and the plate.

(12) Also, to achieve the above object, according to the present invention, in a plate rolling mill comprising upper and lower work rolls, and hydrostatic pressure bearings for supporting barrel portions of the work rolls or barrel portions of support rolls in a non-contact manner with fluid pressure substantially along the horizontal direction, the support rolls supporting the work rolls substantially along the horizontal direction, the plate rolling mill further comprises holding means for holding gaps between the hydrostatic pressure bearings and the work rolls or the support rolls supported by the hydrostatic pressure bearings at a predetermined value.

With the above features, the gaps between the hydrostatic pressure bearings and the work rolls (or the support rolls) are held at the predetermined value by the holding means. Therefore, even when a force tending to deflect the work roll to a larger extent generates transiently immediately after the start of rolling to increase a horizontal force exerted on the hydrostatic pressure bearing supporting the work roll (or the support roll supporting it), the gap between the hydrostatic pressure bearing and the work roll (or the support roll) can be always maintained at the predetermined value regardless of an increase of the horizontal force. It is hence possible to sufficiently and surely prevent those components from being damaged upon contact with each other, and to avoid a lowering of yield.

(13) In the above (12), preferably, the holding means include chocks for rotatably supporting the work rolls or the support rolls.

(14) In the above (13), preferably, the chocks are connected to beams to which the hydrostatic pressure bearings are fixed.

(15) In the above (13), preferably, the chocks are connected to a housing of the plate rolling mill, and the plate rolling mill further comprises chock advancing/-retracting means for moving the chocks back and forth with respect to the housing.

(16) In the above (1) or (12), preferably, each of the hydrostatic pressure bearings has an axial width not smaller than a maximum width of plates to be rolled.

(17) In the above (1) or (12), preferably, the plate rolling mill further comprises detecting means for detecting the gaps between the hydrostatic pressure bearings and the work rolls or the support rolls, and control means for controlling fluid pressures at the hydrostatic pressure bearings in accordance with results detected by the detecting means.

(18) Further, to achieve the above object, according to the present invention, in a plate rolling mill comprising upper and lower work rolls, and hydrostatic pressure bearings for supporting barrel portions of the work rolls or barrel portions of support rolls in a non-contact manner with fluid pressure substantially along the horizontal direction, the support rolls supporting the work rolls substantially along the horizontal direction, the plate rolling mill further comprises means for maintaining gaps between the hydrostatic pressure bearings and the work rolls or the support rolls supported by the hydrostatic pressure bearings to be not smaller than a predetermined value.

(19) Further, to achieve the above object, according to the present invention, in a plate rolling mill comprising upper and lower work rolls for rolling a plate, support rolls for supporting said work rolls substantially along the horizontal direction, hydrostatic pressure bearings for supporting barrel portions of said support rolls with fluid pressure substantially along the horizontal direction, and members disposed on both sides of said support rolls in the axial direction thereof for setting positions of said work rolls to predetermined positions substantially in the horizontal direction.

(20) In the above (19), preferably, the plate rolling mill further comprises, support beams for supporting said hydrostatic pressure bearings, and moving devices capable of moving said hydrostatic pressure bearings through said support beams substantially in the horizontal direction, wherein one of said members for setting positions of said work rolls to predetermined positions substantially in the horizontal direction is mounted to corresponding one of said support beams and comprises a rotating roller or a block.

(21) Further, to achieve the above object, according to the present invention, in a plate rolling mill comprising upper and lower work rolls for rolling a plate,support rolls for supporting said work rolls substantially along the horizontal direction, hydrostatic pressure bearings for supporting barrel portions of said support rolls with fluid pressure substantially along the horizontal direction, detecting devices for detecting gaps between said hydrostatic pressure bearings and said work rolls or said support rolls, and a control unit for controlling fluid pressures at said hydrostatic pressure bearings in accordance with values detected by said detecting devices.

(22) Further, to achieve the above object, according to the present invention, in a rolling method comprising the steps of supporting upper and lower work rolls for rolling a plate by support rolls substantially along the horizontal direction, supporting barrel portions of said support rolls with fluid pressure substantially along the horizontal direction under supply of a fluid, and pressing said work rolls on both sides of said support rolls in the axial direction thereof for setting positions of said work rolls to predetermined positions substantially in the horizontal direction before and after the start of rolling.

(23) Further, to achieve the above object, according to the present invention, in a rolling method comprising the steps of supporting upper and lower work rolls for rolling a plate by support rolls substantially along the horizontal direction, supporting barrel portions of said support rolls with fluid pressure substantially along the horizontal direction under supply of a fluid, and pressing said work rolls at positions axially outside an area corresponding to a maximum width of plates to be rolled for setting positions of said work rolls to predetermined positions substantially in the horizontal direction before and after the start of rolling.

(24) Further, to achieve the above object, according to the present invention, in a rolling method comprising the steps of supporting upper and lower work rolls for rolling a plate by support rolls substantially along the horizontal direction, supporting barrel portions of said support rolls with fluid pressure substantially along the horizontal direction under supply of a fluid, detecting gaps between said hydrostatic pressure bearings and said work rolls or said support rolls, and controlling fluid pressures at said hydrostatic pressure bearings in accordance with detected gap values.

DESCRIPTION OF THE PREFERRED EMBODIMENTS

Preferred embodiments of the present invention will be described below with reference to the drawings.

A first embodiment of the present invention will be described with reference to FIGS. 1 to 22.

Figure 1:
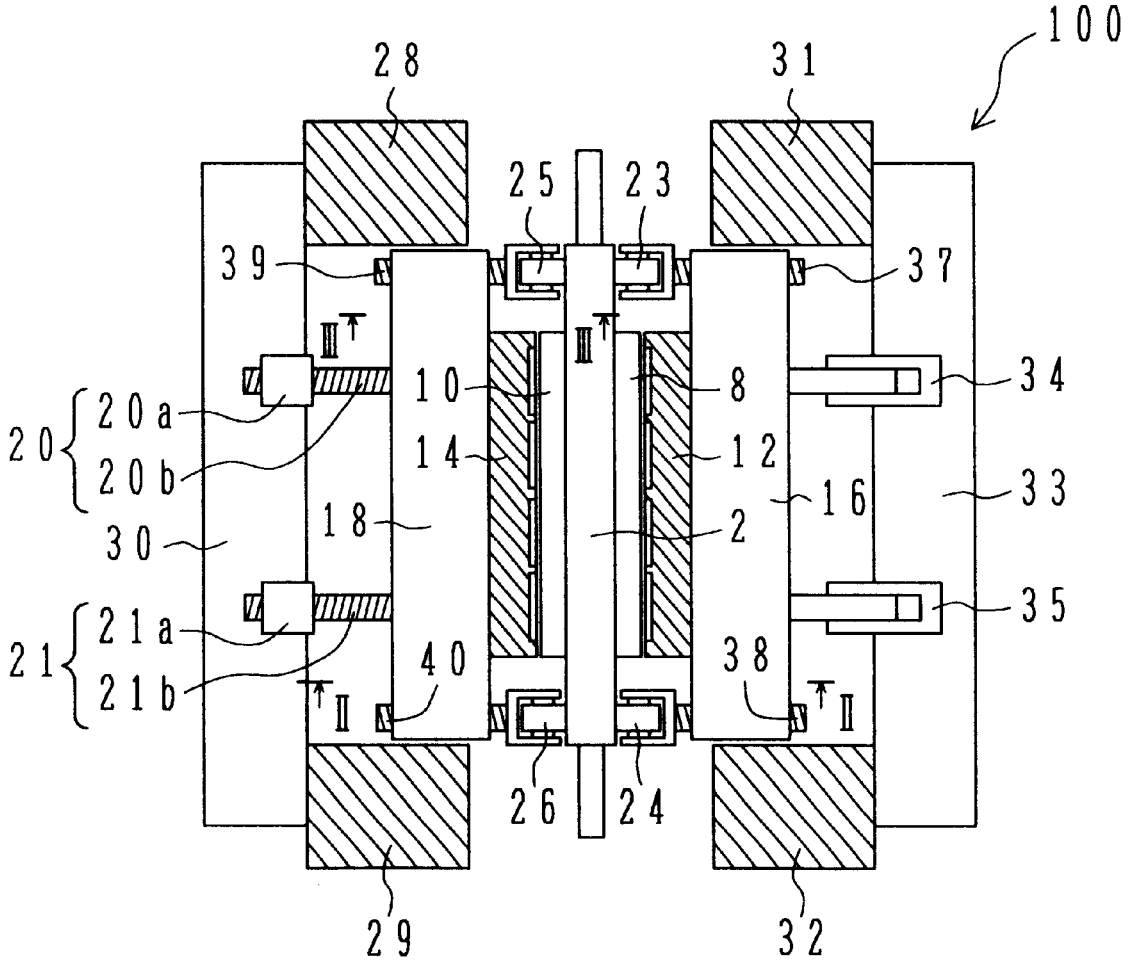
FIG. 1 is a horizontal sectional view of a portion of a rolling mill, including an upper work roll, according to a first embodiment of the present invention.
Figure 2:
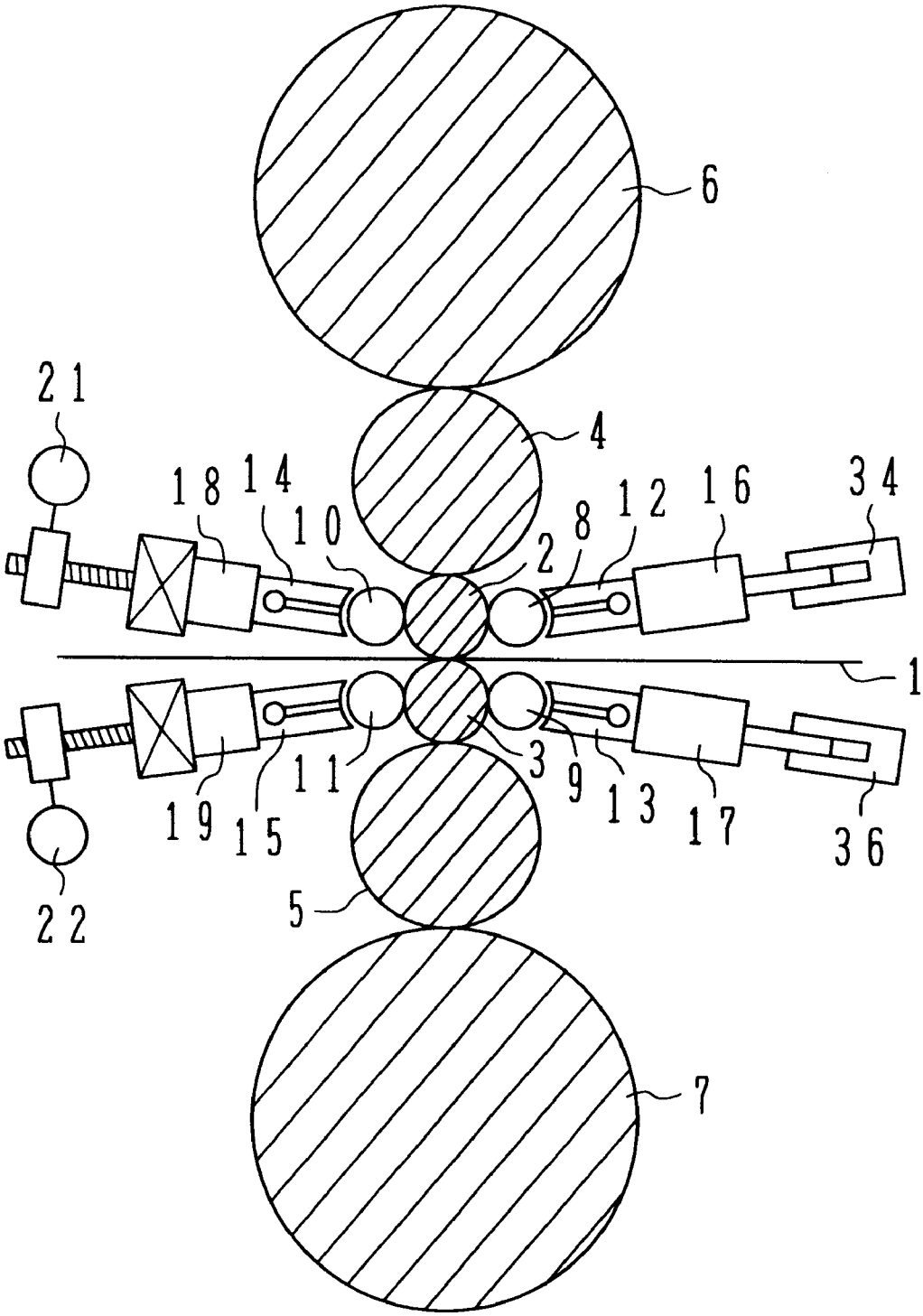
FIG. 2 is a cross-sectional view taken along line II—II in FIG. 1.
Figure 3:
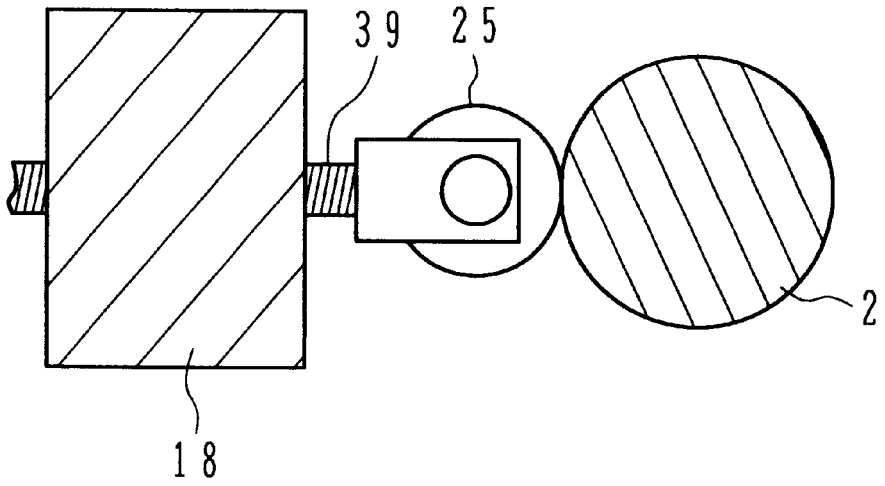
FIG. 3 is a cross-sectional view taken along line III—III in FIG. 1.

FIG. 1 is a horizontal sectional view of a portion of a rolling mill, including an upper work roll, according to the first embodiment, FIG. 2 is a cross-sectional view taken along line II—II in FIG. 1, and FIG. 3 is a cross-sectional view taken along line III—III in FIG. 1.

Referring to FIGS. 1 to 3, a rolling mill 100 comprises upper and lower work rolls 2, 3 for rolling a plate 1, intermediate rolls 4, 5 and back-up rolls 6, 7 for supporting the work rolls 2, 3 along the vertical direction, idler rolls 8, 9, 10 and 11 for supporting the work rolls 2, 3 along the horizontal direction, hydrostatic pressure bearings 12, 13, 14 and 15 for supporting barrel portions of the idler rolls 8 to 11 substantially along the horizontal direction with fluid (e.g., oil) pressure in a floated noncontact state (while gaps are left therebetween), support beams 16, 17, 18 and 19 to which the hydrostatic pressure bearings 12–15 are mounted respectively and each of which has sufficient rigidity, hydrostatic-pressure-bearing moving devices 20, 21, 22, etc. (referred to simply as hydrostatic-pressure-bearing moving devices 20, 21, 22 hereinafter) capable of changing positions of the work rolls 2, 3 with respect to the intermediate rolls 4, 5 in the direction of pass line between the incoming and outgoing sides, and gap restraining rolls 23, 24, 25, 26, etc. (referred to simply as gap restraining rolls 23, 24, 25, 26 hereinafter) disposed in positions axially outside the areas of the work rolls 2, 3 where the plate 1 having a maximum width passes, and positioned close to the work rolls 2, 3 substantially in the horizontal direction (in either directly contact relation or opposing relation with a small gap left therebetween).

The work rolls 2, 3 are supported by the idler rolls 8–11 and the gap restraining rolls 23–26 in both directions from the incoming and outgoing sides such that the work rolls are disposed substantially at the center of the rolling mill 100.

The intermediate rolls 4, 5 are connected to and driven by motors (not shown) for transmitting driving forces to the work rolls 2, 3.

The hydrostatic pressure bearings 12–15 have an axial width larger than the maximum width of the plate 1.

The hydrostatic-pressure-bearing moving devices 20, 21 are provided on a beam 30 extending between housing posts 28 and 29, and include respectively motors 20*a*, 21*a* and screw shafts 20*b*, 21*b* movable back and forth by driving forces of the motors 20*a*, 21*a*. Also, each of the hydrostatic-pressure-bearing moving devices 22, etc. has a similar structure. The structures of the hydrostatic-pressure-bearing moving devices 20–22 are not limited to the above-mentioned one, and moving functions of these devices may be realized by any other suitable mechanism.

Positions of the support beams 18, 19 are regulated by the hydrostatic-pressure-bearing moving devices 20–22 in the direction of pass line between the incoming and outgoing sides, whereby the positions of the work rolls 2, 3 can be changed with respect to the intermediate rolls 4, 5 in the direction of pass line between the incoming and outgoing sides.

The support beams 16, 17 are pressed toward the work roll 2 under certain forces by pushing cylinders 34, 35, 36, etc. (referred to simply as pushing cylinders 34, 35, 36 hereinafter) which are provided on beams 33, etc. (referred to simply as beams 33 hereinafter) extending between housing posts 31 and 32.

Note that the support beams 16, 18 are retractable backward when the rolls are replaced.

The gap restraining rolls 23, 24; 25, 26 serve to prevent the gaps between the hydrostatic pressure bearings 12–15 and the idler rolls 8–11 from becoming smaller than a predetermined value, and are fixed respectively to the support beams 16, 18. Various manners are conceivable to fix the gap restraining rolls to the support beams. For example, screw rods 37, 38; 39, 40 engaging respectively the gap restraining rolls 23, 24; 25, 26 are inserted in and meshed with threaded holes (not shown) cut through the support beams 16, 18. By properly adjusting the amounts of advances of the screw rods 37–40, minimum gaps between the hydrostatic pressure bearings 12–15 and the idler rolls 8–11 can be set appropriately.

In the above arrangement, the idler rolls 8–11 constitute support rolls for supporting the work rolls substantially along the horizontal direction. The gap restraining rolls 23–26 constitute not only roller means provided in contact with the work rolls substantially in the horizontal direction, but also stopper means for preventing the gaps between the hydrostatic pressure bearings and the support rolls supported by the hydrostatic pressure bearings from becoming smaller than the predetermined value.

Figure 4:
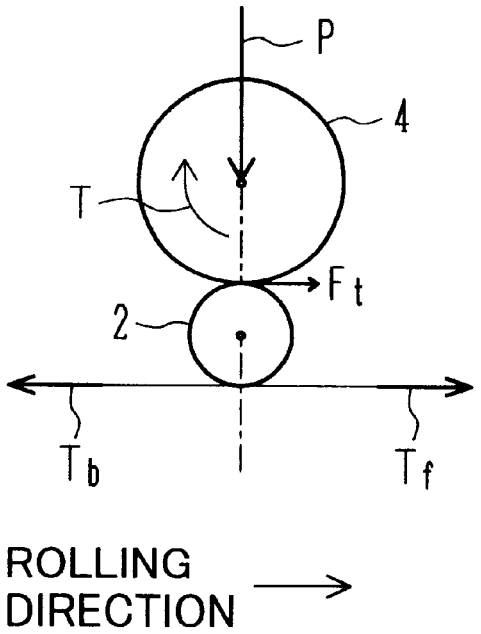
FIG. 4 is a schematic view for explaining procedures at the start of rolling.

In the thus-constructed rolling mill 100 of this embodiment, rolling is started similarly to the usual procedures in rolling mills of the similar type. Taking the upper work roll 2, by way of example, as shown in FIG. 4, the procedures are as follows. The plate 1 to be rolled is first threaded between the work rolls 2 and 3 which are in a state moved away from the pass line (thereafter the plate is held standstill). The work rolls 2, 3 are then tightened to press the plate under a predetermined load P. After applying a front tension Tf and a back tension Tb to the plate, the intermediate rolls 4, 5 are each rotated with a torque T to drive the work rolls 2, 3 by a driving tangential force Ft, thus starting the rolling of the plate.

As is apparent from the above procedures, in the state immediately before the start of the rolling, the driving tangential force Ft does not yet act on the work roll. At the same time as when the rolling starts, the driving tangential force Ft generates and acts on the work roll abruptly. Because of such a discontinuous condition, forces tending to deflect the work rolls 2, 3 to a larger extent generate transiently and horizontal forces imposed on the hydrostatic pressure bearings 12–15 through the idler rolls 8–11 increase immediately after the start of the rolling. Accordingly, the gaps between the hydrostatic pressure bearings 12–15 and the idler rolls 8–11 (i.e., the amounts of floating of the rolls) are going to reduce momentarily. In this embodiment, however, the gap restraining rolls 23–26 are provided in contact with the work rolls 2, 3 substantially in the horizontal direction, and serve as stoppers for holding the work rolls 2, 3 always substantially at the center of the rolling mill 100 and hence preventing the gaps between the hydrostatic pressure bearings 12–15 and the idler rolls 8–11 supported by the hydrostatic pressure bearings from becoming smaller than the predetermined value set beforehand. As a result, the gaps between the hydrostatic pressure bearings 12–15 and the idler rolls 8–11 supported by the hydrostatic pressure bearings can be always held not smaller than the predetermined value to sufficiently and surely prevent the hydrostatic pressure bearings and the idler rolls from being damaged upon contact with each other. Thus a lowering of yield of the rolled plate 1 can be avoided.

Further, since the gap restraining rolls 23, 24, 25, 26 contact the work rolls 2, 3 substantially in the horizontal direction at positions axially outside the areas of the work rolls 2, 3 where the plate 1 having the maximum width passes, the surface properties of the rolled plate can be kept from deteriorating due to marks left on the plate upon the contact between the work rolls and the plate.

While the above description of the first embodiment does not refer to control for the amounts of floating of the idler rolls 8–11 which control is performed for the hydrostatic pressure bearings 12–15 under normal conditions (including other states than the transient state immediately after the start of the rolling), the control can be performed, for example, as follows. The control process will be described with reference to FIGS. 5 to 9, taking the hydrostatic pressure bearing 12 as an example.

Figure 5:
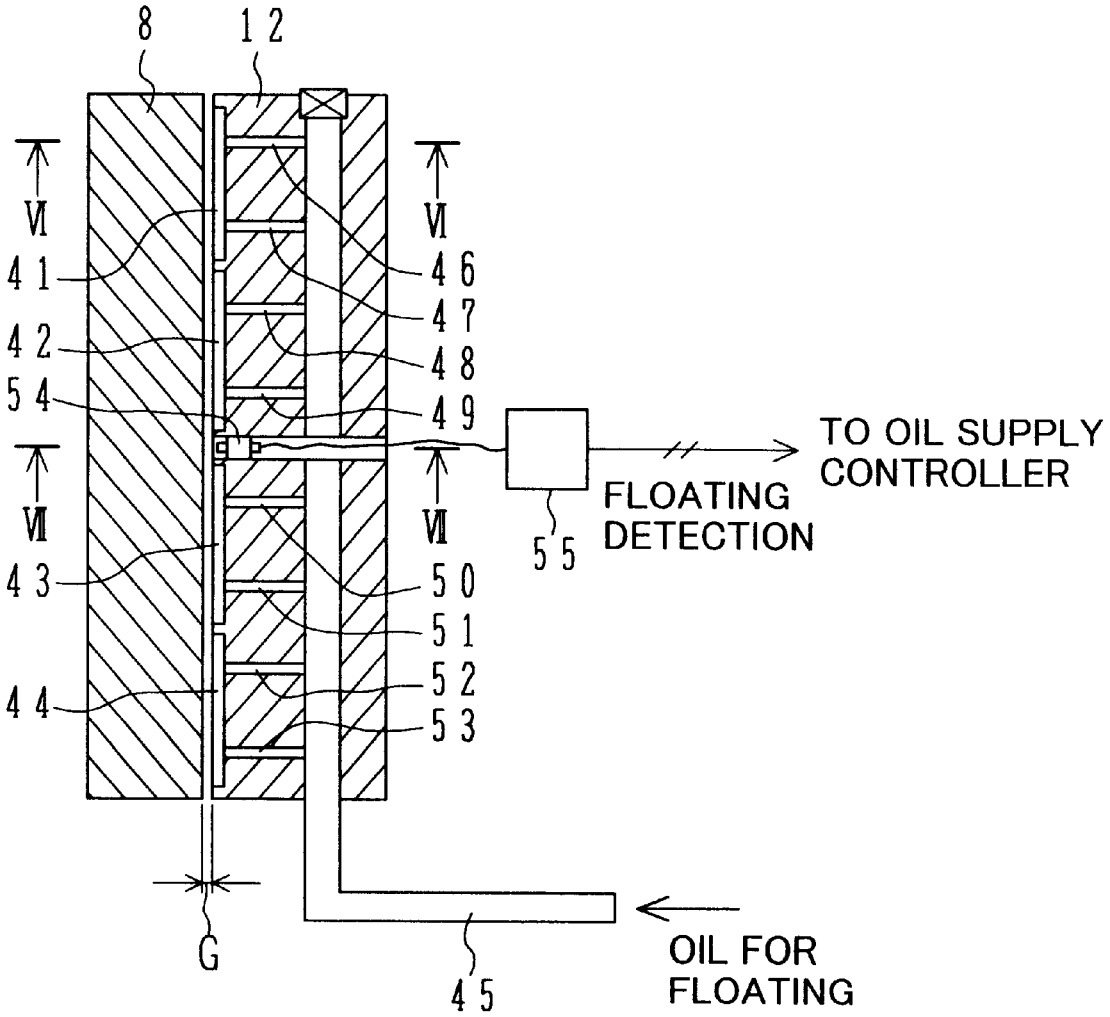
FIG. 5 is a horizontal sectional view showing one example of a detailed structure of a hydrostatic pressure bearing and thereabout.
Figure 6:
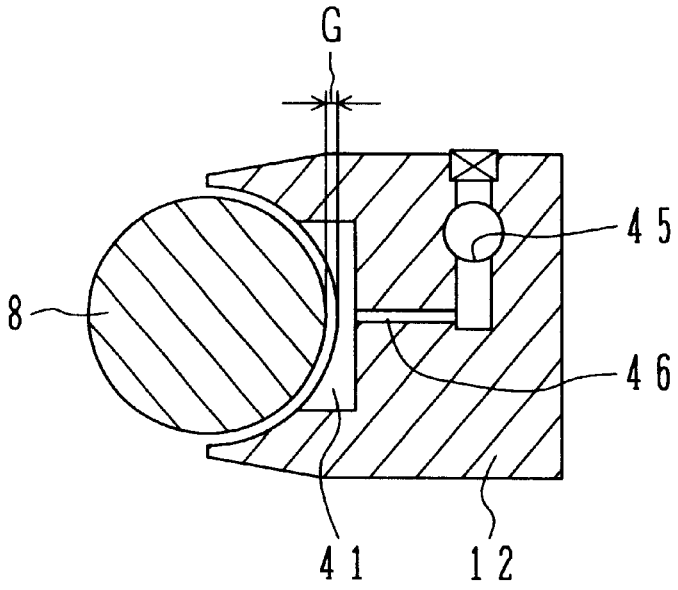
FIG. 6 is a cross-sectional view taken along line VI—VI in FIG. 5.
Figure 7:
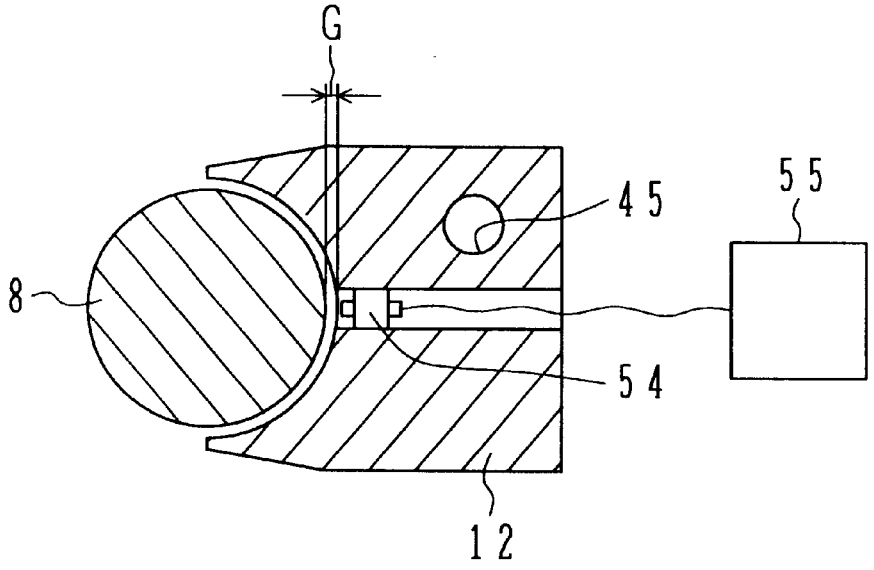
FIG. 7 is a cross-sectional view taken along line VII—VII in FIG. 5.

FIG. 5 is a horizontal sectional view showing a detailed structure of the hydrostatic pressure bearing 12 and thereabout, FIG. 6 is a cross-sectional view taken along line VI—VI in FIG. 5, and FIG. 7 is a cross-sectional view taken along line VII—VII in FIG. 5.

Referring to FIGS. 5 to 7, the hydrostatic pressure bearing 12 has oil reservoir pockets 41, 42, 43 and 44 formed in its surface contacting the idler roll 8 to produce forces for floating the idler roll 8. A fluid (e.g., oil) supplied from a fluid source (not shown) for floating the idler roll is introduced to a main oil supply hole 45 after a flow rate of the oil has been controlled by a flow control valve which is controlled by an oil supply controller (described later). The oil is then sent to the pockets 41–44 through small-diameter sub-oil supply holes 46, 47, 48, 49, 50, 51, 52 and 53 which are branched from the main oil supply hole 45. In the above arrangement, the amount of floating of the idler roll 8 is detected by a gap detector 54 embedded in a central portion of the hydrostatic pressure bearing 12. A detection signal is amplified by an amplifier 55 and then outputted to the oil supply controller (not shown).

Figure 8:
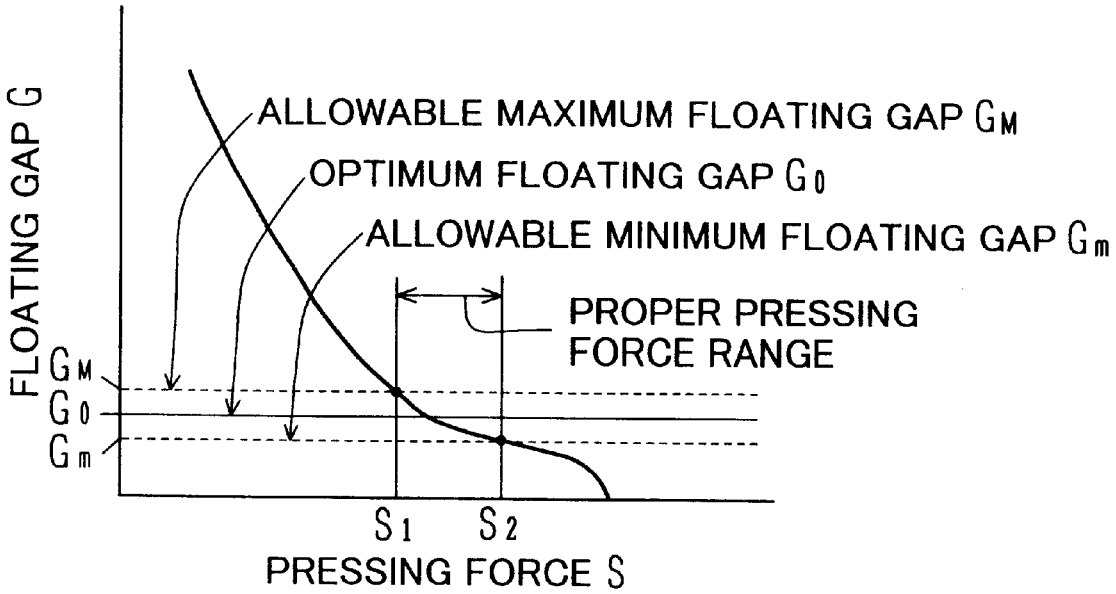
FIG. 8 is a graph showing the relationship between a horizontal pressing force S applied to an idler roll from the hydrostatic pressure bearing and a gap (floating gap) therebetween at a constant pressure of a fluid supplied for floating the roll.

FIG. 8 shows the relationship between a horizontal pressing force S applied to the idler roll 8 from the hydrostatic pressure bearing 12 and the gap (floating gap) G therebetween on condition that the fluid for floating the idler roll has a supply pressure q (=constant).

Generally, an optimum value Go of the floating gap G is about 1/1000 of the diameter of the idler roll 8. In accordance with such a general rule, the radius of the idler roll 8 is designed beforehand to be smaller than that of the hydrostatic pressure bearing 12 by the value Go.

Figure 9:
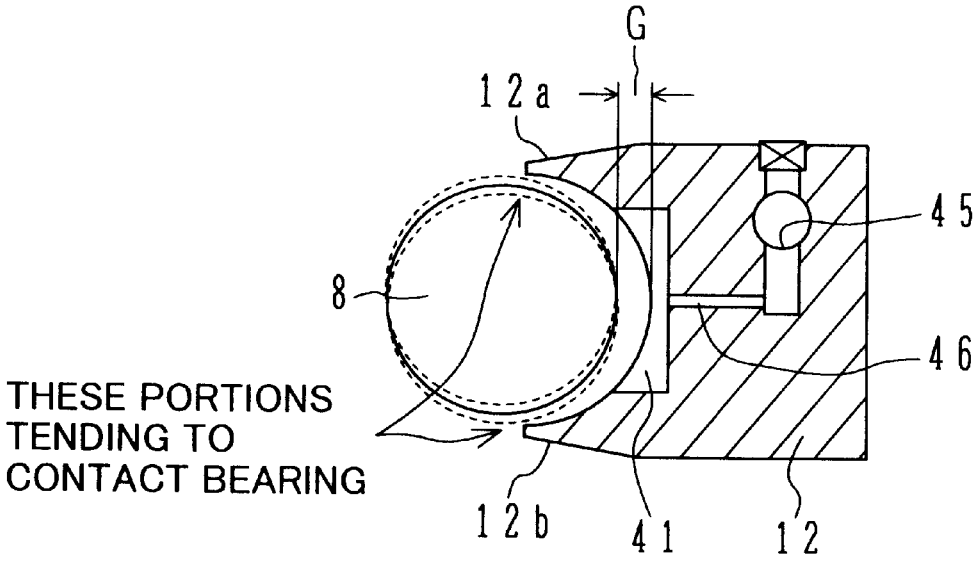
FIG. 9 is a schematic view for explaining a drawback that occurs if the floating gap is too large.

For example, if the floating gap G is smaller than Go, i.e., $G<Go$, a possibility that the idler roll 8 contacts a bottom portion of the hydrostatic pressure bearing 12 is increased, and therefore a probability of damaging the idler roll is also increased. Conversely, if the floating gap G is too large, another problem arises. The too-large floating gap G makes the position of the idler roll 8 so unstable that the idler roll wobbles in the vertical direction as shown in FIG. 9. Upon the wobbling, the idler roll 8 tends to more easily contact shoulder portions 12*a*, 12*b* of the hydrostatic pressure bearing 12. Thus, since the idler roll 8 and/or the hydrostatic pressure bearing 12 may be damaged in either case of the floating gap G being too small or large, there exists a certain allowable range ($Gm \leqq G \leqq GM$) as shown in FIG. 8. Based on the above consideration, a proper pressing force range ($S1 \leqq S \leqq S2$) is determined corresponding to the allowable range of the floating gap from the graph of FIG. 8.

In view of the foregoing, the oil supply controller performs the flow rate control to keep the horizontal pressing force S within the above proper range, thereby holding the floating gap G, i.e., the gap between the idler roll 8 and the hydrostatic pressure bearing 12, at an appropriate value. Incidentally, the gap detector 54 constitutes detecting means for detecting the gap between the hydrostatic pressure bearing and the support roll, and the oil supply controller constitutes control means for controlling fluid pressure at the hydrostatic pressure bearing in accordance with a result detected by the detecting means.

Figure 10:
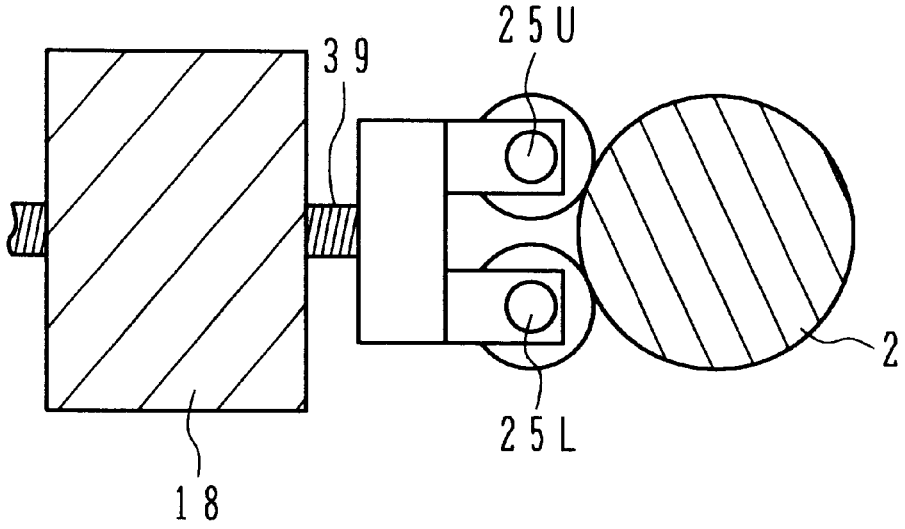
FIG. 10 shows a modification in which the number of gap restraining rolls is increased.

In the above-described first embodiment, one gap restraining roll 25 (or 23, 24, 26) is provided in contact with the upper work roll 2 at each of four positions, i.e., two opposite positions located respectively near the operating side and the driving side on each of the incoming and outgoing sides, by way of example, as shown in FIG. 3. The present invention is however not limited to that arrangement. As shown in FIG. 10, two gap restraining rolls (denoted by 25U, 25L in a modification of FIG. 10) may be provided at each of the four positions. This modification requires a larger space for installing the gap restraining rolls, but is more desired taking into account stability of the work roll in the vertical direction.

Figure 11:
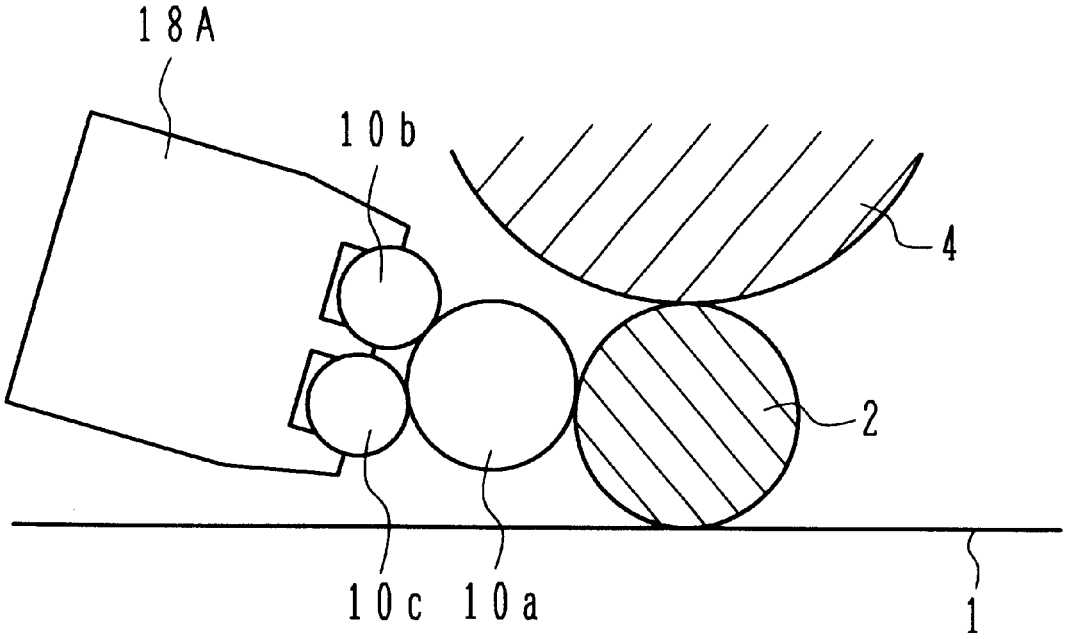
FIG. 11 shows a modification in which the number of idler rolls is increased.

As another modification of the first embodiment, the upper work roll 2 may be supported by three idler rolls 10*a*, 10*b* and 10*c*, by way of example, as shown in FIG. 11. More specifically, the idler roll 10*a* directly contacts the upper work roll 2 to support it substantially along the horizontal direction. The idler rolls 10*b*, 10*c* contact the idler roll 10*a* to support it at two points spaced in the vertical direction, and a hydrostatic pressure bearing 18A supports barrel portions of the idler rolls 10*b*, 10*c*. This modification has advantages as follows. Generally, a roll held by a hydrostatic pressure bearing is made of a material having relatively high hardness and being less abraded in many cases because minute change of the roll diameter changes the amount of floating of the roll supported in a non-contact manner and greatly affects a floating capability of the roll. Further, since work rolls function as reduction rolls, each work roll is also made of a material having relatively high hardness in many cases. In the structure, shown in FIG. 2, that the idler rolls 8–12 supported by the hydrostatic pressure bearings 12–15 directly contact the work rolls 2 and 3, therefore, if any foreign matter should enter between the rolls in contact with each other, both the rolls are damaged because of having relatively high hardness. On the other hand, in the structure, shown in FIG. 11, that the idler roll 10*a* is interposed between-the idler rolls 10*b*, 10*c* supported by the hydrostatic pressure bearing 18A and the work roll 2, the idler roll 10*a* can be made of a material having relatively low hardness, thus resulting in that only the idler roll 10*a* having relatively low hardness is damaged even in the case of any foreign matter entering between the rolls. Accordingly, the idler rolls 10*b*, 10*c* and the work roll 2 can be kept from being not damaged. Those modifications can also provide similar advantages as described above.

Figure 12:
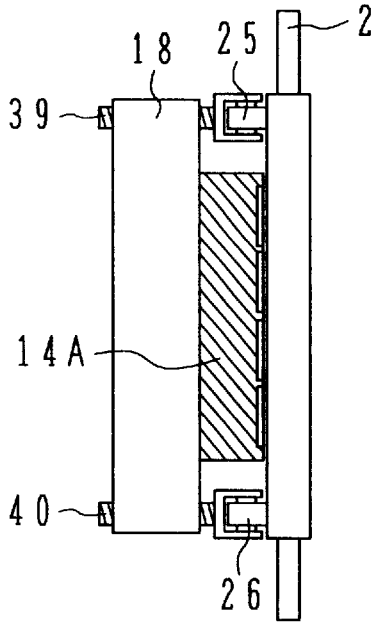
FIG. 12 shows a modification in which a work roll is supported by the hydrostatic pressure bearing in a non-contact manner.
Figure 13:
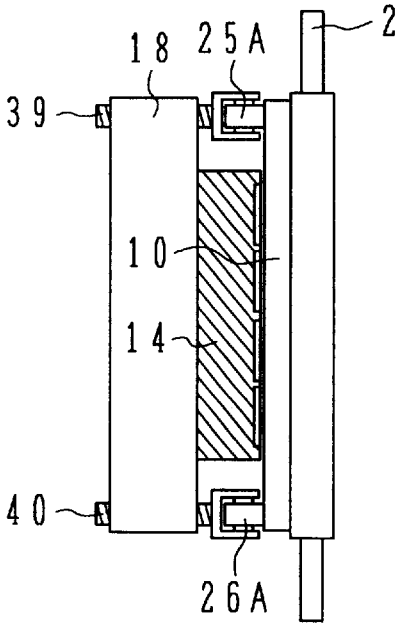
FIG. 13 shows a modification in which gap restraining rolls are provided in contact with the idler roll.
Figure 14:
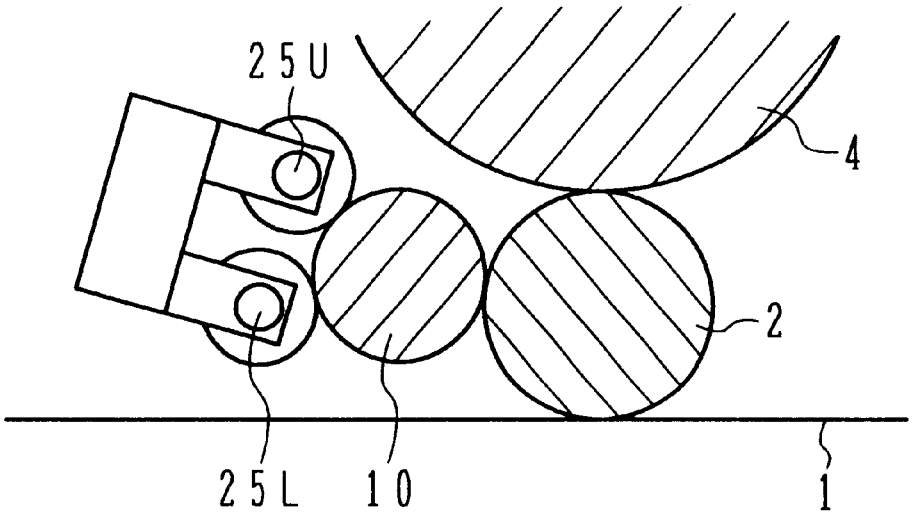
FIG. 14 shows a modification in which the number of gap restraining rolls is increased.

In the above-described first embodiment, the gap restraining rolls 23–26 are provided in direct contact with the upper work roll 2, for example, whereas the upper work roll 2 is indirectly supported by the hydrostatic pressure bearings 12, 14 through the idler rolls 8, 10 supporting the upper work roll 2 along the horizontal direction. The present invention is however not limited to that arrangement. As shown in FIG. 12, the upper work roll 2 may be itself supported in a non-contact manner by hydrostatic pressure bearings 14A, etc. (only one side being shown). Though not particularly specified again below, such an equivalent relation in supporting structure between the idler roll and the work roll (i.e., the fact that various means associated with the idler roll are also applicable to the work roll as well) is similarly applied to each of the relevant structures described in this specification. Conversely, as shown in FIG. 13, gap restraining rolls 25A, 26A, etc. (only one side being shown) may be provided in contact with the idler rolls 8 and 10, whereas the upper work roll 2 is likewise supported by the hydrostatic pressure bearings 12, 14 through the idler rolls 8, 10. In this connection, as shown in FIG. 14, the gap restraining rolls 25A, etc. may be each divided, for example, into two upper and lower rolls 25U, 25L so that the gap restraining rolls contact the idler roll 10 at two positions spaced in the vertical direction. Those modifications can also provide similar advantages as described above.

Further, in the above-described first embodiment, the gap restraining rolls 23–26 serving as the stopper means are provided to prevent the gaps between the hydrostatic pressure bearings 12–15 and the idler rolls 8–11 from becoming smaller than the predetermined value set beforehand. The present invention is however not limited to that arrangement, but may include holding means for holding the gaps between the hydrostatic pressure bearings and the support rolls supported by the hydrostatic pressure bearings at a predetermined value. Such modifications are shown in FIGS. 15 and 16.

Figure 15:
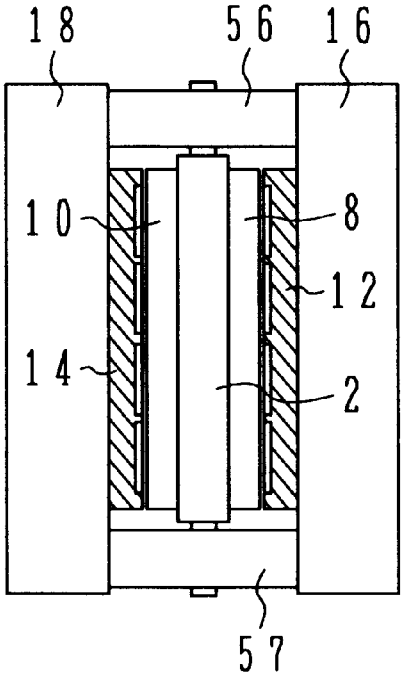
FIG. 15 shows a modification in which work roll chocks are provided to hold the gap between the hydrostatic pressure bearing and the idler roll at a predetermined value.

In one modification of FIG. 15, work roll chocks 56, 57 for rotatably supporting the upper work roll 2, for example, are provided at both axial ends of the upper work roll 2. The chocks 56, 57 are coupled to the support beams 16, 18 to which the hydrostatic pressure bearings 12, 14 are mounted, respectively. Note that the chocks 56, 57 can be released from the state coupled to the support beams 16, 18 for roll replacement.

Figure 16:
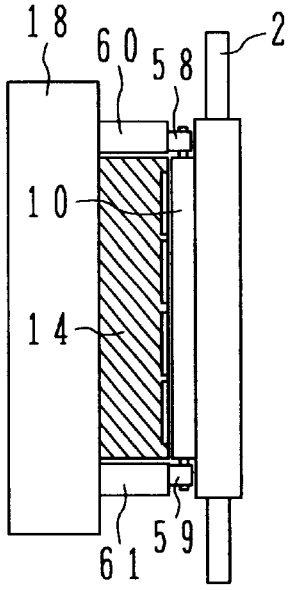
FIG. 16 shows a modification in which work roll chocks are provided to hold the gap between the hydrostatic pressure bearing and the idler roll at a predetermined value.

FIG. 16 shows another modification wherein idler roll chocks 58, 59 for rotatably supporting the idler roll 10 are provided at both axial ends of each of the idler rolls 10, etc. (only one side being shown) which support the upper work roll 2, for example. The chocks 58, 59 are connected through fixing bases 60, 61 to the support beam 18 to which the hydrostatic pressure bearing 14 is mounted.

With the modifications shown in FIGS. 15 and 16, the gaps between the hydrostatic pressure bearings 14, etc. and the idler rolls 10, etc. are held by the chocks 56, 57 (58, 59) at a predetermined value that is structurally decided. In other words, even when, immediately after the start of the rolling, forces tending to deflect the work roll 2, etc. to a larger extent generate transiently to increase horizontal forces imposed on the hydrostatic pressure bearings 14, etc. supporting the idler rolls 10, etc. which in turn support the work rolls 2, etc., as described above in connection with the first embodiment, the gaps between the hydrostatic pressure bearings 14, etc. and the idler rolls 10, etc. can be always maintained at the predetermined value regardless of an increase of the horizontal forces. As a result, the idler rolls and the hydrostatic pressure bearings can be sufficiently and surely prevented from being damaged upon contact with each other. Thus a lowering of yield of the rolled plate can be avoided.

Moreover, in the above-described first embodiment, the gap restraining rolls 23–26 are provided as the stopper means to prevent the gaps between the hydrostatic pressure bearings 12–15 and the idler rolls 8–11 from becoming smaller than the predetermined value set beforehand. The present invention is however not limited to that arrangement, but may include another stopper means. Such a modification will now be described with reference to FIGS. 17 and 18.

Figure 17:
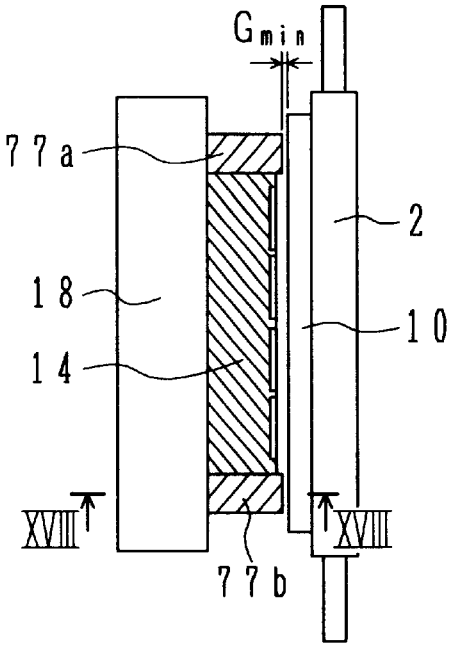
FIG. 17 shows another modification of stopper means.
Figure 18:
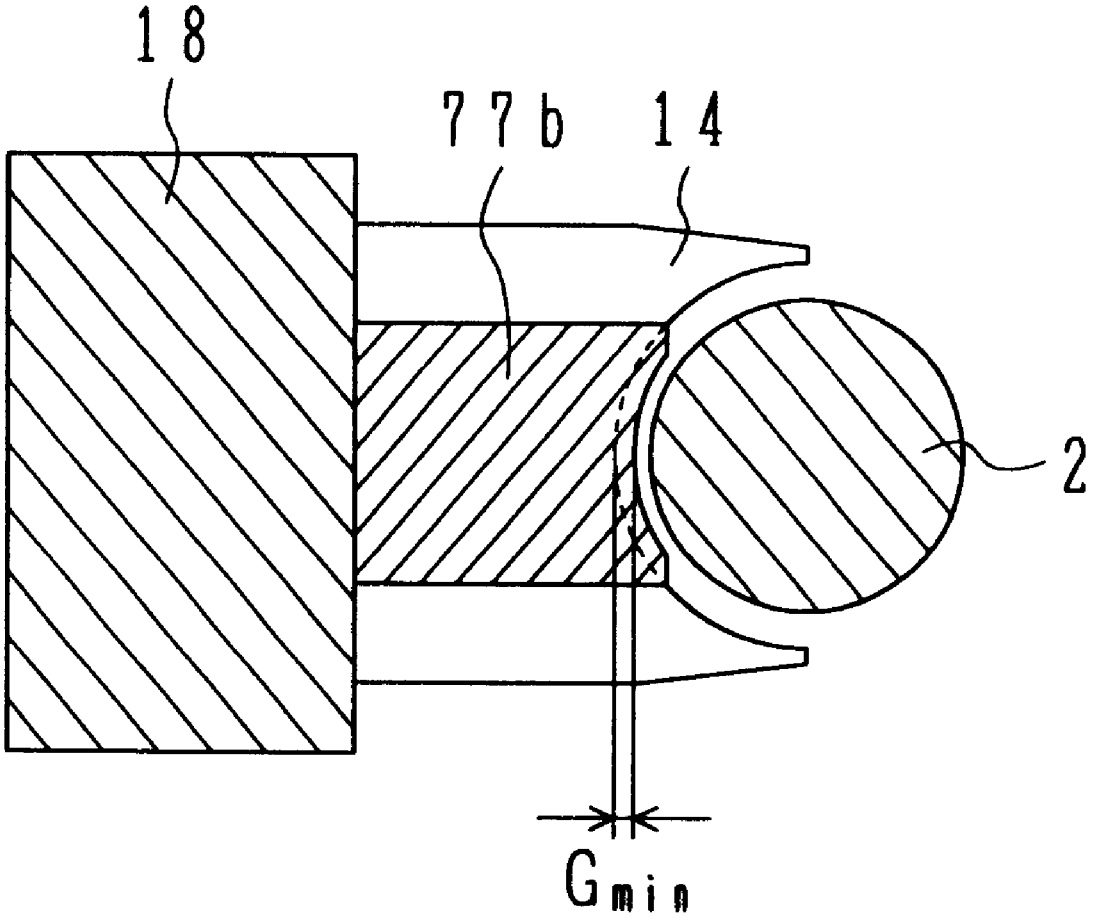
FIG. 18 is a cross-sectional view taken along line XVIII—XVIII in FIG. 17.

FIG. 17 is a horizontal sectional view showing a principal part of the structure of the modification, and FIG. 18 is a cross-sectional view taken along line XVIII—XVIII in FIG. 17. Referring to FIGS. 17 and 18, by way of example, gap restraining blocks 77*a*, 77*b* serving as the stopper means are provided on both sides (at positions axially outside the area corresponding to the maximum width of the plate 1) of the hydrostatic pressure bearing 14 in the axial direction which supports in a non-contact manner the idler roll 10 associated with the upper work roll 2. The gap restraining blocks 77*a*, 77*b* are fixed to extend toward the idler roll 10, and a step difference between distal ends of the gap restraining blocks 77*a*, 77*b* and inner surfaces of the hydrostatic pressure bearing 14 is set, as shown, to a predetermined allowable minimum gap Gmin (that may be the same as Gm in FIG. 8).

The gap restraining blocks 77*a*, 77*b* are structured to be removable so that they can be replaced if worn off or made rough in surfaces. The gap restraining blocks 77*a*, 77*b* primarily serve to prevent momentary contact between the idler roll and the hydrostatic pressure bearing, and are not always in slide contact with the idler roll under large forces. Therefore, the materials of the gap restraining blocks 77*a*, 77*b* are not limited to metals, but may be, e.g., Teflon or other resins.

In the above construction, if a force tending to deflect the work roll 2, for example, to a larger extent generates transiently to make the idler roll 10 come closer to the hydrostatic pressure bearing 14 immediately after the start of the rolling, the idler roll 10 first contacts the gap restraining blocks 77*a*, 77*b* provided at both the axial ends before going to contact the hydrostatic pressure bearing 14. The contact between the idler roll 10 and the gap restraining blocks 77*a*, 77*b* prevents the gap between the hydrostatic pressure bearing 14 and the idler roll 10 from becoming smaller than the predetermined value (the allowable minimum gap Gm in this case) set beforehand. Upon the contact, slip scratch may be caused in portions of the idler roll 10 contacting the gap restraining blocks 77*a*, 77*b*, but those scratch are positioned axially outside the area corresponding to the maximum width of the plate 1. It is therefore possible to avoid adverse effects on the plate 1 being rolled.

Accordingly, as with the first embodiment, the gaps between the hydrostatic pressure bearings 14, etc. and the idler rolls 10, etc. can be always held not smaller than the predetermined value, whereby the hydrostatic pressure bearings and the idler rolls can be sufficiently and surely prevented from being damaged upon contact with each other. Thus a lowering of yield of the rolled plate 1 can be prevented.

Figure 19:
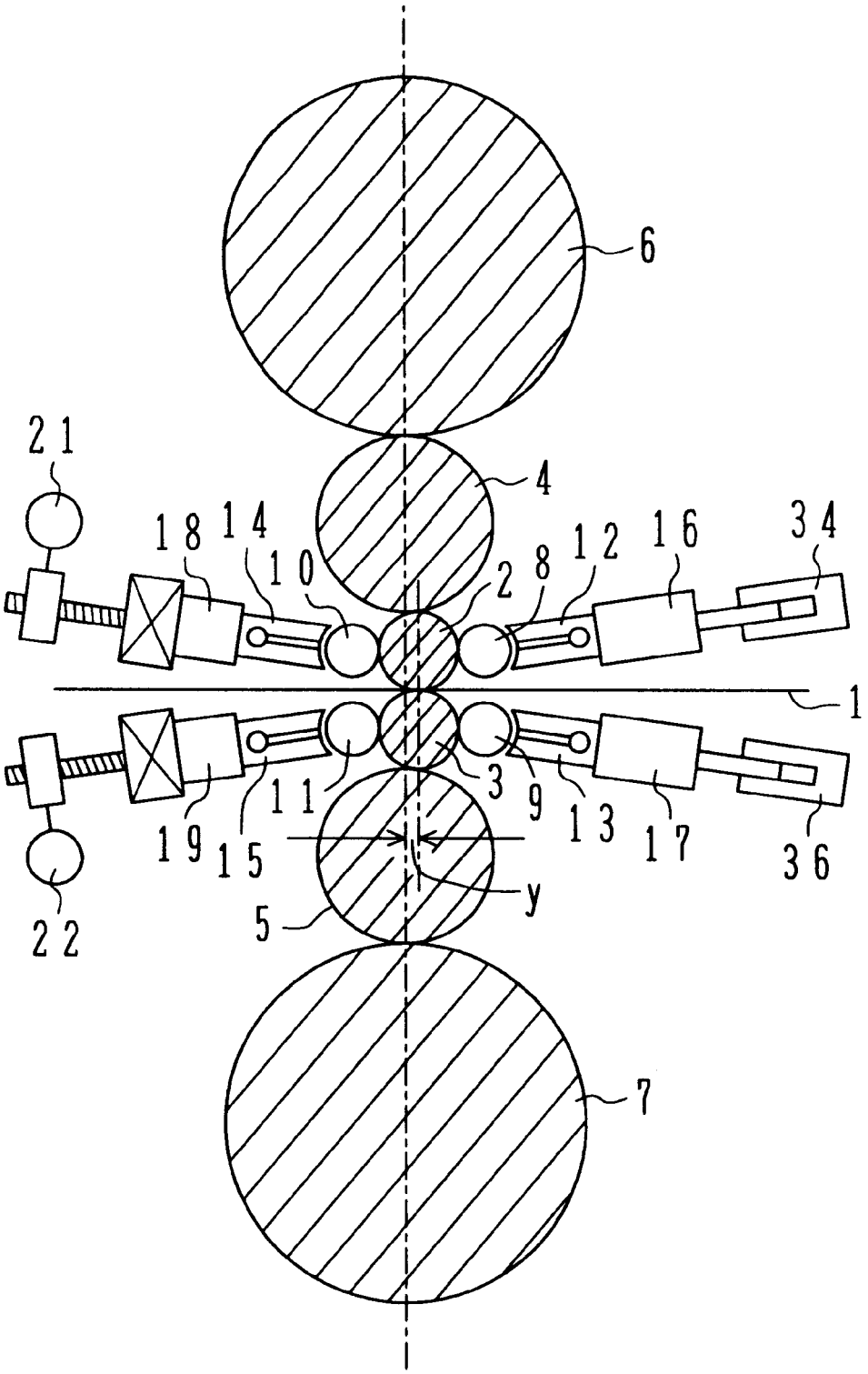
FIG. 19 shows a modification in which the work rolls are offset with respect to intermediate rolls.

In the above-described first embodiment, the work rolls 2, 3 are disposed substantially at the center of the rolling mill 100, as shown in FIGS. 1 and 2, primarily aiming to prevent contact between the hydrostatic pressure bearings 14, etc. and the idler rolls 10, etc. upon generation of the transient horizontal forces immediately after the start of the rolling. The present invention is however not limited to that arrangement, but may be combined with the well-known offset control for suppressing horizontal deflections of the rolls caused by horizontal forces occurred during the rolling operation immediately after the start thereof. The positions of the work rolls 2, 3 with respect to the intermediate rolls 4, 5 in the direction of pass line between the incoming and outgoing sides may be changed by using the hydrostatic-pressure-bearing moving devices 20, 21, 22, etc. so that the work rolls 2, 3 are offset with respect to the intermediate rolls 4, 5 by a distance y, for example, as shown in FIG. 19. This modification can provide, in addition to the advantages obtainable with the above first embodiment, a specific advantage resulted from the application of the offset control. The specific advantage will be described below.

Usually, in the offset control, the offset amount y is set to an appropriate value which is decided depending on the rolling load, the rolling torque, the front and back tensions, etc., so that forces imposed on the work rolls 2, 3 in the horizontal direction are suppressed. A manner of calculating the offset amount y will now be described with reference to FIG. 20.

Figure 20:
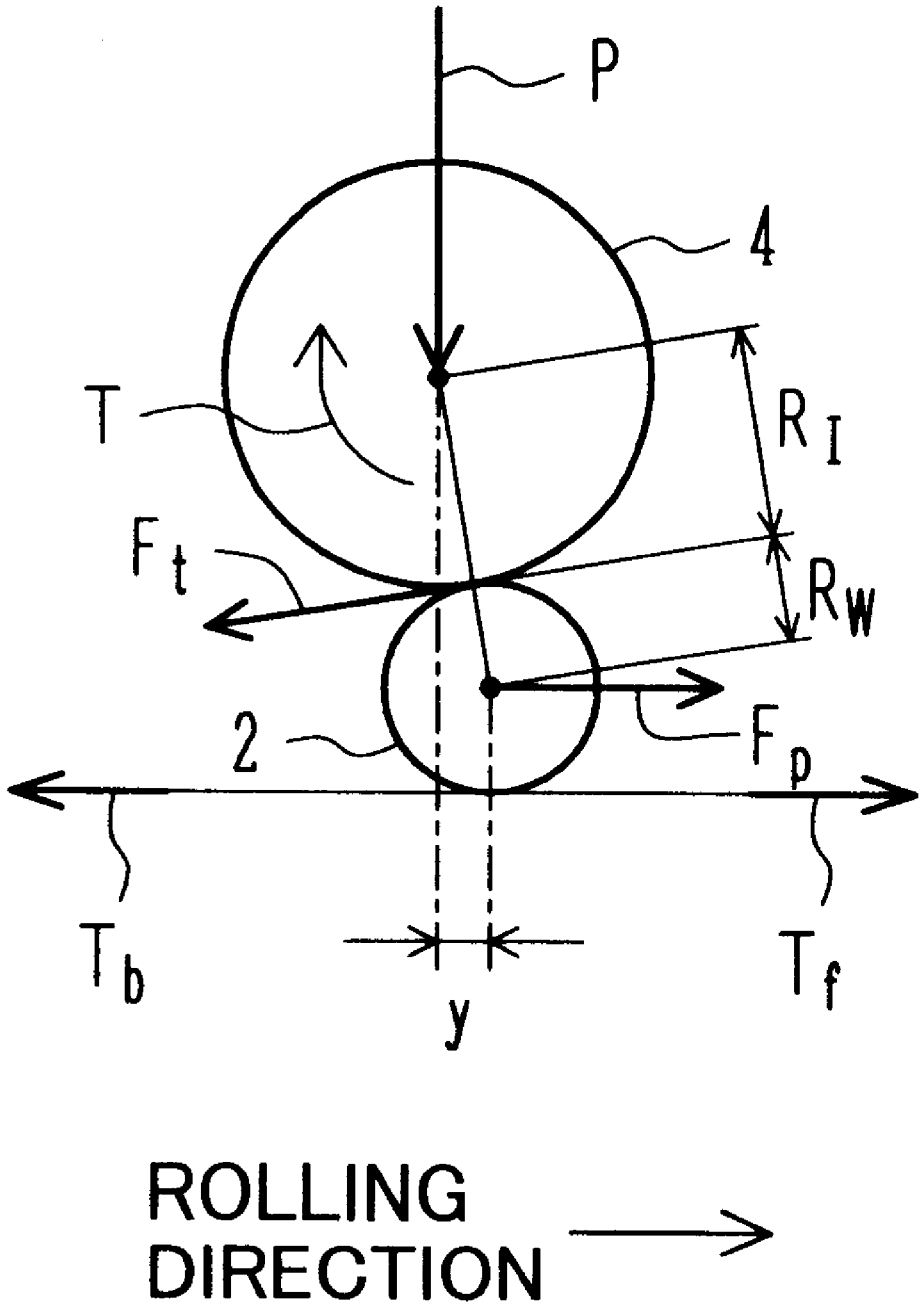
FIG. 20 is a schematic view for explaining a manner of calculating the amount of offset.

Referring to FIG. 20, assuming similarly to the case of FIG. 4 that the back tension (directing the incoming side) and the front tension (directing the outgoing side) imposed on the plate 1 are respectively Tb and Tf, the driving tangential force caused by a torque T applied from the intermediate roll 4 is Ft, and a horizontal component of the rolling load P is FP, a horizontal force SL imposed on the work roll 2, for example, is expressed by:

$$SL=Tf-FP+(Tb-Tf)/2 \quad (1)$$

Furthermore, assuming that the radius of the intermediate roll 4 is RI and the radius of the work roll 2 is RW, the driving tangential force Ft and the load horizontal component FP are expressed by:

$$Ft=T/RI \quad (2)$$

$$FP=P\cdot y/(RI+RW) \quad (3)$$

Putting the formulae (2) and (3) in the formula (1) and rearranging it, the offset amount y corresponding to the horizontal force SL is expressed by:

$$y=(T/RI+(Tb-Tf)/2-SL)(RI+RW)/P \quad (4)$$

In the formula (4), the rolling load P, the torque T and the tensions Tb, Tf can be calculated once the rolling conditions are decided, and the roll radii RI, RW are also known beforehand from the structural design. By selecting a certain value (generally zero) of SL not larger than the allowable value in the formula (4) before the start of the rolling, an optimum offset amount $y_o$ which is effective to prevent an excessive horizontal force from acting on the work roll can be determined in advance. Accordingly, by starting the rolling after setting the centers of the work rolls 2, 3 to be offset with respect to the centers of the intermediate rolls 4, 5 by the amount $y_o$, the work rolls 2, 3 can be kept from undergoing excessive horizontal forces and hence from causing horizontal deflections.

The above description is a summary of the method for suppressing horizontal deflections of the work rolls based on the offset control.

Here, the offset amount $y_o$ corresponding to the horizontal force SL=0 is a value effective during the rolling. In practical operation, as described above in connection with the first embodiment, the driving tangential force Ft does not yet act on the work roll immediately before the start of the rolling. In such a state, the driving tangential force Ft attributable to the torque is not effective, and only the load horizontal component FP is effective in the formula (1). At that time, therefore, a horizontal force SL' imposed on the work roll 2 is expressed below by putting Tf=0 in the formula (1):

$$SL'=-FP+(Tb-Tf)/2 \quad (5)$$

An attempt to make SL' zero in the above state is realized only by increasing the back tension Tb. However, an increase of the back tension would cause a slip of the plate at the start of the rolling, and the stable rolling would not be obtained. For that reason, the front and back tensions Tb, Tf are usually set to values almost equal to each other. During a period of time (e.g., several seconds) from the application of the rolling load P to the start of rotation of the intermediate roll 4, therefore, SL' −FP holds, and if the rolling load is large, SL' also takes a relatively large value. This considerably increases the horizontal force imposed on the hydrostatic pressure bearing 12 during the period of time. Accordingly, the amount of floating of the idler roll 8 from the hydrostatic pressure bearing 12 (i.e., the gap therebetween) tends to reduce during the period of time.

With this modification, the problem of such a tendency is overcome as follows. Since the gap restraining rolls 23, 24, 25, 26 are provided in contact with the work rolls 2, 3 substantially in the horizontal direction as described above in connection with the first embodiment, the gap restraining rolls 23, 24, 25, 26 also function as stoppers for several seconds at the start of the rolling to cope with the horizontal forces SL' specific to the offset control, and can effectively prevent the gaps between the hydrostatic pressure bearings 12–15 and the idler rolls 8–11 from becoming smaller than the predetermined value set beforehand.

Figure 21:
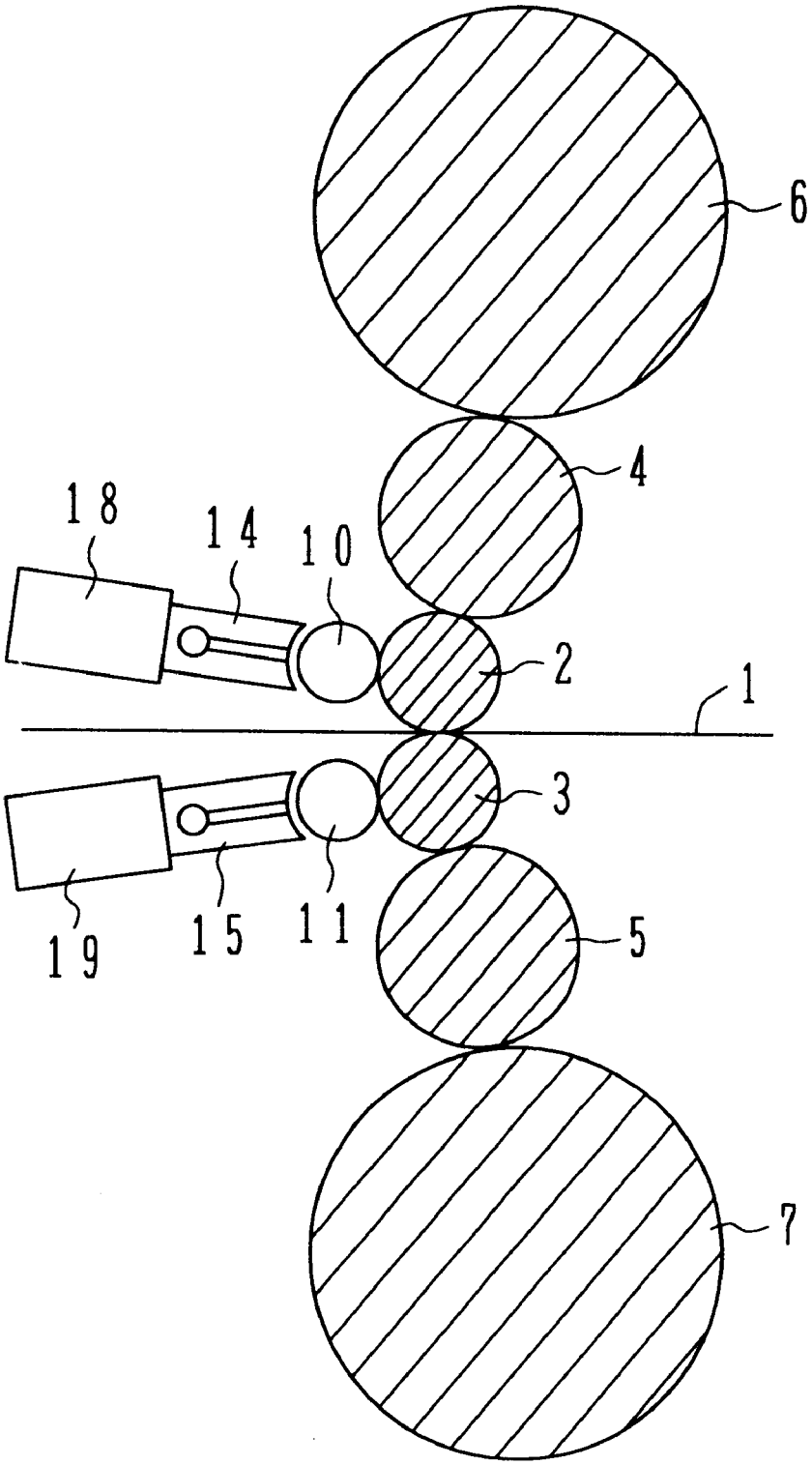
FIG. 21 shows a modification in which the idler rolls are provided only on the side toward which the work rolls are offset.
Figure 22:
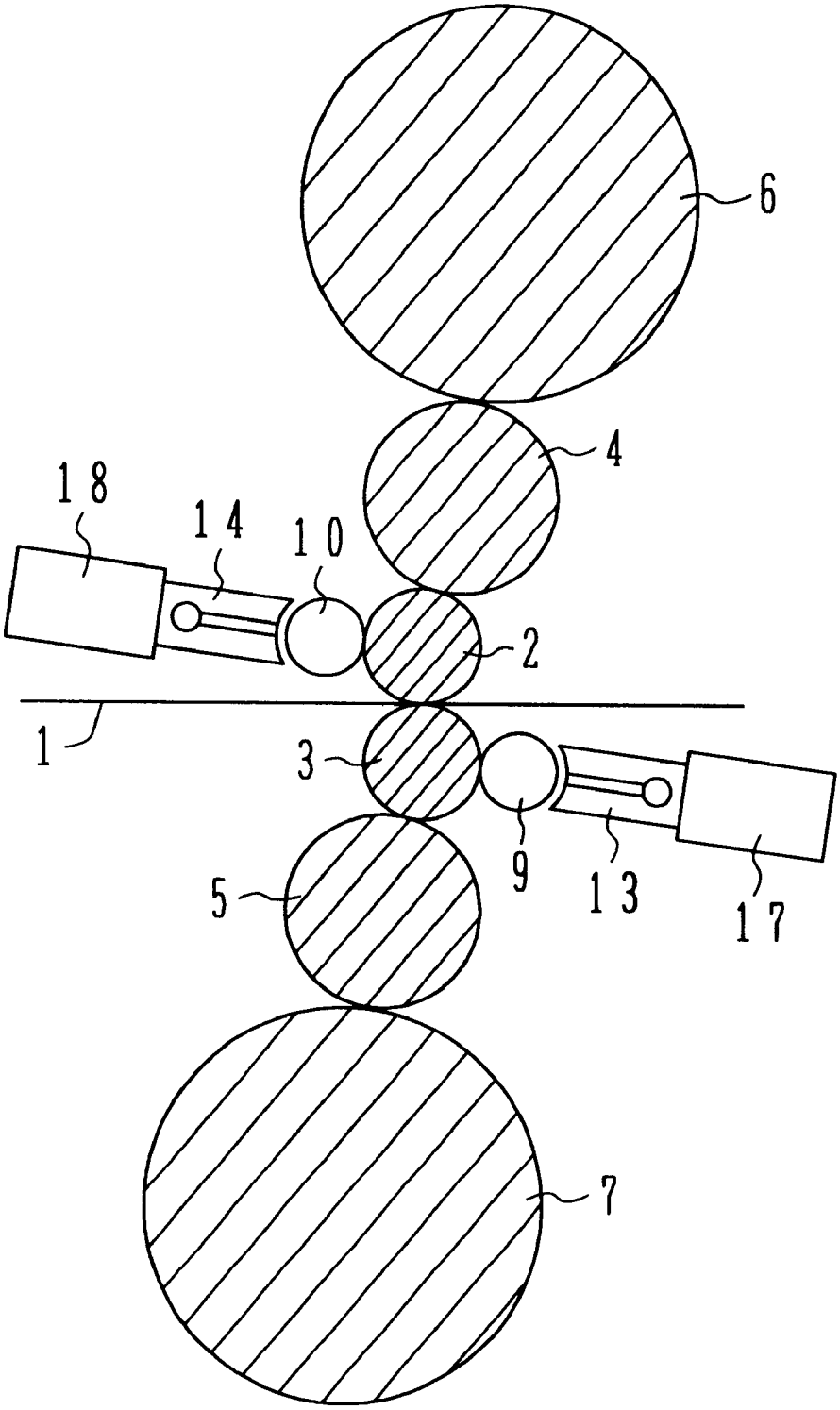
FIG. 22 shows a modification in which upper and lower work rolls are offset in opposite directions.

While the offset work rolls 2, 3 are supported in the above modification by the hydrostatic pressure bearings 12–15 through the idler rolls 8–11 on both the incoming and outgoing sides, the present invention is not limited to that arrangement. As shown in FIG. 21, by way of example, the work rolls 2, 3 may be supported by the hydrostatic pressure bearings 12–15 through the idler rolls 10, 11 only from the side toward which the work rolls 2, 3 are offset, and the work rolls 2, 3 may be supported by the gap defining rolls (not shown) only from the same side. This modification contributes to reducing an equipment cost. As still another modification, the work rolls 2, 3 may be offset in opposed directions on the upper and lower sides as shown in FIG. 22.

A second embodiment of the present invention will be described with reference to FIG. 23. This embodiment additionally has a function of adjusting forces pressing hydrostatic pressure bearings against idler rolls.

Figure 23:
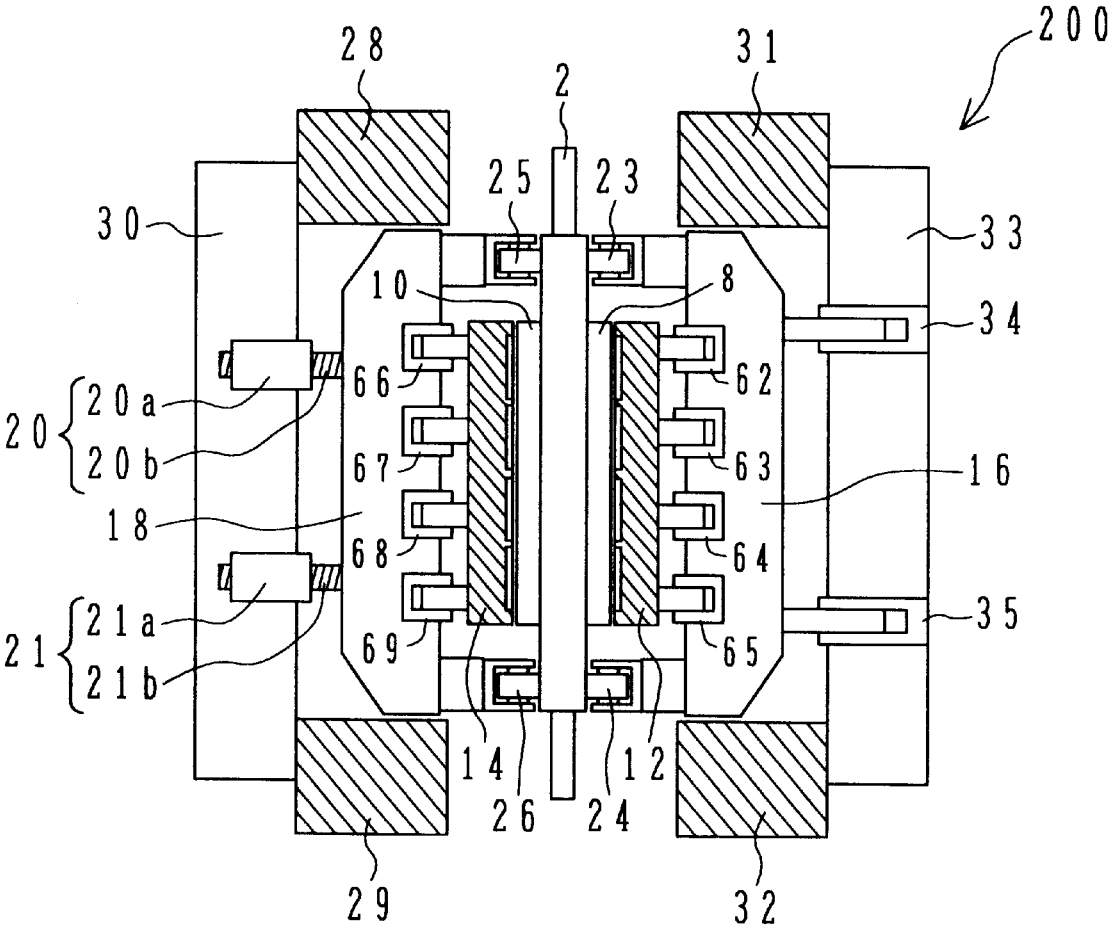
FIG. 23 is a horizontal sectional view of a portion of a rolling mill, including an upper work roll, according to a second embodiment of the present invention.

FIG. 23 is a horizontal sectional view of a portion of a rolling mill 200, including an upper work roll, according to the second embodiment. Common parts to those in FIG. 1 are denoted by the same numerals, and are not described here. The rolling mill 200 according to the second embodiment differs from the rolling mill 100 according to the first embodiment in that hydrostatic pressure bearings 12–15 supporting the idler rolls 8–11 in a non-contact manner, which in turn support work rolls 2, and 3, are not directly fixed to the support beams 16–19, but are pressed toward the work rolls 2, 3 under predetermined forces by a plurality of hydraulic cylinders 62, 63, 64, 65; 66, 67, 68, 69, etc. (only the structure associated with the support beams 16, 18 being shown) provided on the support beams 16–19.

In the above arrangement, the pressing forces applied from the hydraulic cylinders 62–69, etc. are preferably controlled in combination with the flow rate control performed by the oil supply controller for the hydrostatic pressure bearings 12–15, described above with reference to FIGS. 5–9, so that the pressing forces S imposed on the idler rolls 8–11 from the hydrostatic pressure bearings 12–15 are each finally kept within the proper pressing force range ($S1 \leqq S \leqq S2$) shown in FIG. 8.

This second embodiment can also provide similar advantages as obtainable with the above first embodiment.

A third embodiment of the present invention will be described with reference to FIGS. 24–27. In this embodiment, gap restraining rolls are fixed to housing posts. Common parts to those in the first and second embodiments are denoted by the same numerals, and are not described here.

Figure 24:
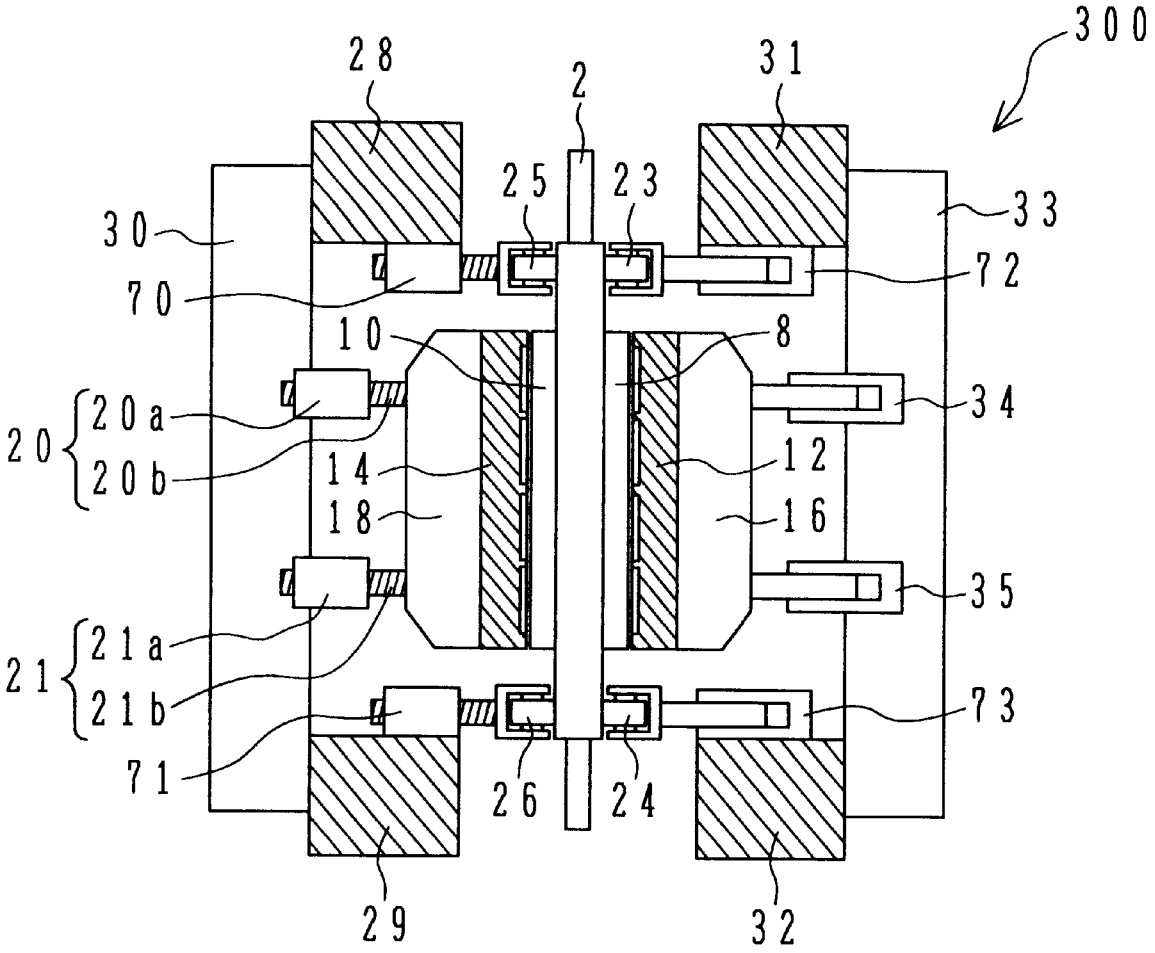
FIG. 24 is a horizontal sectional view of a portion of a rolling mill, including an upper work roll, according to a third embodiment of the present invention.

FIG. 24 is a horizontal sectional view of a portion of a rolling mill 300, including an upper work roll, according to the third embodiment. The rolling mill 300 according to the third embodiment differs from the rolling mill 100 according to the first embodiment in that gap restraining rolls 23–26, etc. are not fixed to support beams 16–19, etc., but, for example, one pair of gap restraining rolls 25, 26 are movably provided by work-roll moving devices 70, 71 mounted on housing posts 28, 29, while the other pair of gap restraining rolls 23, 24 are pressed against a work roll 2 under predetermined forces by hydraulic cylinders 72, 73 mounted on housing posts 31, 32.

On the side of the work-roll moving devices 70, 71 (on the left side in FIG. 24), the position of the work roll 2 is first set (e.g., to the center of the rolling mill 300) by the work-roll moving devices 70, 71. The positions of the hydrostatic-pressure-bearing moving devices 20, 21 are then set so that the gap between the idler roll 10 and the hydrostatic pressure bearing 14 is equal to a predetermined value Go (e.g., 1/1000 of the diameter of the idler roll 10). Specifically, the above setting can be performed below. Pressure supplied for floating the hydrostatic pressure bearing 14 is made zero, and the hydrostatic pressure bearing 14 is contacted with the idler roll 10 under a very weak force. After setting the gap G to be zero in that state, the hydrostatic pressure bearing 14 is moved by the value Go with the hydrostatic-pressure-bearing moving devices 20, 21.

On the side of the hydraulic cylinders 72, 73 (on the right side in FIG. 24), the hydraulic cylinders 72, 73 for pressing the gap restraining rolls 23, 24 mounted to the housing posts 31, 32 apply forces sufficiently large to counter against the horizontal forces generated due to the rolling. As described above in connection with the above second embodiment, the pressing force applied from the hydrostatic pressure bearing 12 through pushing cylinders 34, 35 is held within the predetermined proper range.

In the above arrangement, the hydraulic cylinders 72, 73 and the work-roll moving devices 70, 71 constitute roller advancing/retracting means for moving the roller means back and forth with respect to the housing.

This third embodiment can also provide similar advantages as obtainable with the above first and second embodiments.

In the third embodiment, the gap restraining rolls 23–26 are supported by the work-roll moving devices 70, 71 provided on the left side and the hydraulic cylinders 72, 73 on the right side as viewed in FIG. 24. The present invention is however not limited to that arrangement, and work-roll moving devices may be provided on both sides.

Alternatively, hydraulic cylinders may be provided on both sides. In this case, oil pressures of the hydraulic cylinders on one side may be regulated to adjust the amount of floating of the idler roll 10. Such a modification will be described below with reference to FIG. 25.

Figure 25:
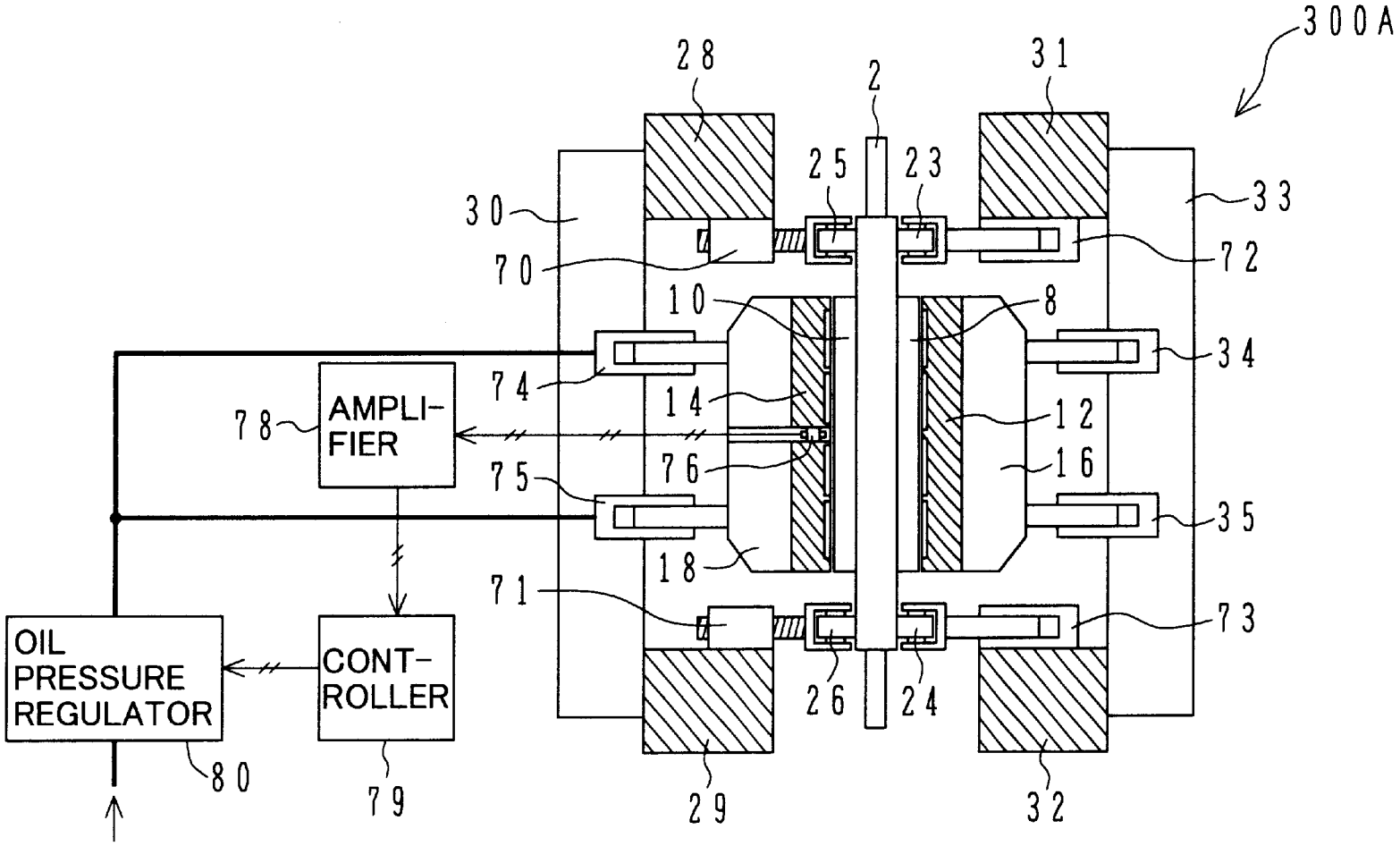
FIG. 25 shows a modification in which the amount of floating of an idler roll is adjusted by regulating oil pressure of a hydraulic cylinder.

In a rolling mill 300A shown in FIG. 25, hydraulic cylinders 74, 75 for pressing the support beam 18 are provided in stead of the hydrostatic-pressure-bearing moving devices 20, 21 in FIG. 24. The gap (floating gap) G between the idler roll 10 and the hydrostatic pressure bearing 14, for example, is detected by a measuring device 76. A detection signal is amplified by an amplifier 78 and then inputted to a controller 79. The controller 79 compares the detected G with the allowable lower limit value Gm and upper limit value GM shown in FIG. 8. If $G<Gm$, the controller 79 outputs a pressure lowering signal to an oil pressure regulator 80 which includes a hydraulic control valve for regulating oil pressure applied to the hydraulic cylinders 74, 75 from an oil pressure source (not shown), thereby lowering the oil pressure to reduce the pressing force S imposed on the idler roll 10 from the hydrostatic pressure bearing 14. On the other hand, if $G>GM$, the controller 79 outputs a pressure raising signal to the oil pressure regulator 80, thereby raising the oil pressure to increase the pressing force S imposed on the idler roll 10 from the hydrostatic pressure bearing 14.

As an alternative, the work-roll moving devices 70, 71 may be employed as shown in FIG. 24 instead of the hydraulic cylinders 74, 75 and driving of the work-roll moving devices 70, 71 may be controlled in accordance with the gap G detected by the measuring device 76 as described above.

These modifications can also provide similar advantages as obtainable with the above third embodiment.

As an application of the modification shown in FIG. 25, horizontal bending control may be performed by utilizing the detected gap G. More specifically, the end positions of the work roll 2, etc. are kept substantially fixed by the gap restraining rolls 23–26, etc. during the rolling operation immediately after the start thereof. Hence, if change of the gap G is detected by the measuring device 76 during the rolling operation, it is highly possible that the change is primarily attributable to deflections of the work roll 2, etc. caused by the horizontal forces imposed on them. In other words, those deflections of the work roll 2, etc. can be suppressed by applying horizontal bending forces. Such a modification is shown in FIG. 26.

Figure 26:
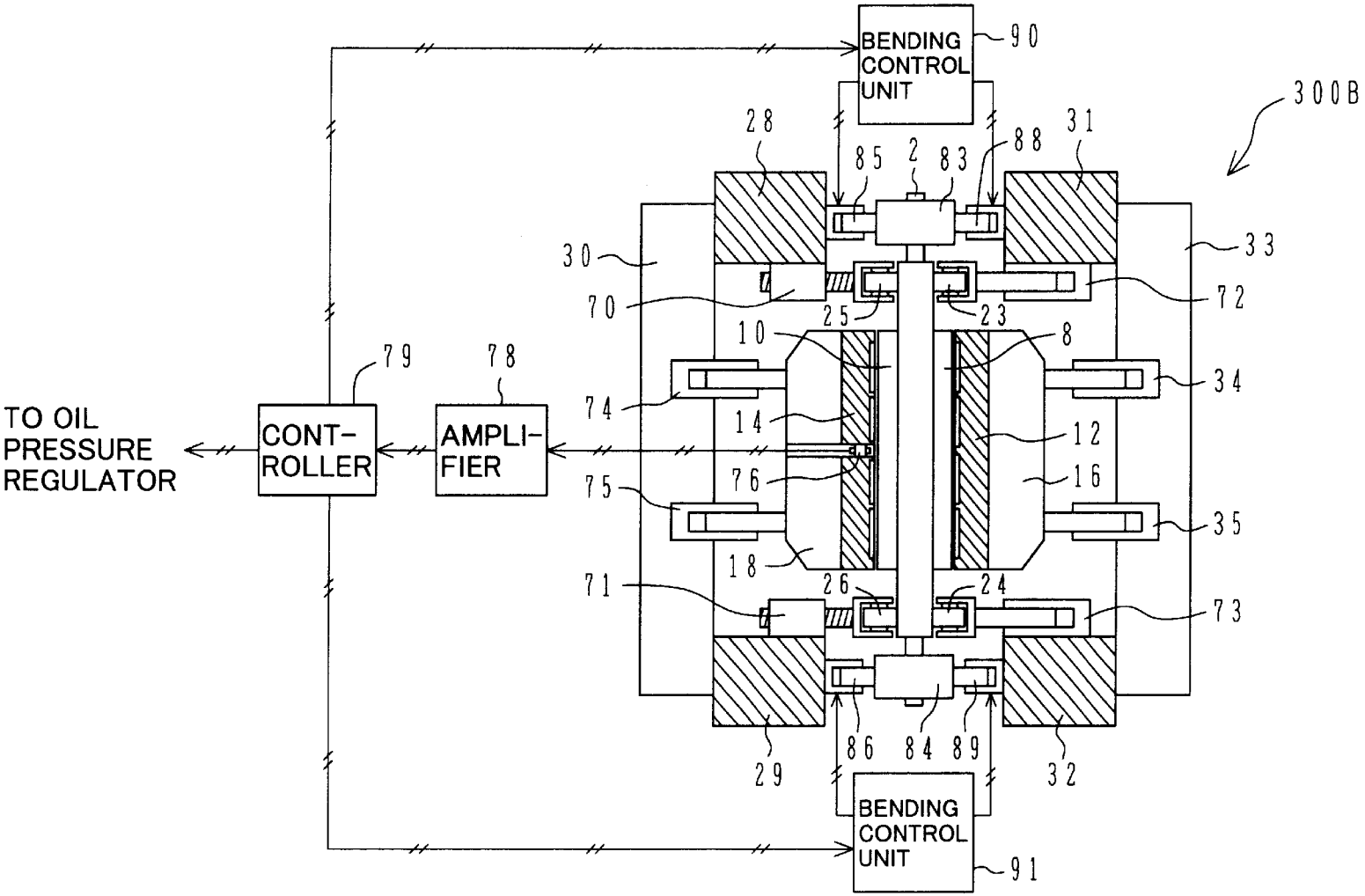
FIG. 26 shows a modification in which a horizontal bending force is applied to suppress a horizontal deflection.

Referring to FIG. 26, a rolling mill 300B includes work roll chocks 83, 84 for rotatably supporting the upper work roll 2, for example. The work roll chocks 83, 84 are provided axially outward of both axial ends of the upper work roll 2 at which the gap restraining rolls 23–26 are disposed to face the upper work roll 2. Horizontal bending forces are applied to the work roll chocks 83, 84 by hydraulic cylinders 85, 88 mounted respectively to the housing posts 28, 31 and by hydraulic cylinders 86, 89 mounted respectively to the housing posts 29, 32.

To describe in more detail, the gap (floating gap) G between the idler roll 10 and the hydrostatic pressure bearing 14 is detected by the measuring device 76. A detection signal is amplified by the amplifier 78 and then inputted to the controller 79. If $G<Gm$, the controller 79 outputs control signals to bending control units 90, 91 which include hydraulic control valves for regulating oil pressures applied to the hydraulic cylinders 85, 88 and the hydraulic cylinders 86, 89 from the oil pressure source (not shown), whereupon the bending control units 90, 91 output signals for operating the hydraulic cylinders 88, 89 through the hydraulic control valves so that the horizontal bending forces are applied in the direction to increase the floating gap. On the other hand, if $G>GM$, the controller 79 outputs control signals to the bending control units 90, 91 which in turn output signals for operating the hydraulic cylinders 85, 86 so that the horizontal bending forces are applied in the direction to reduce the floating gap.

This modification can provide, in addition to similar advantages as obtainable with the above third embodiment, an additional advantage that horizontal deflections of the work rolls during the rolling operation can be further suppressed.

Figure 27:
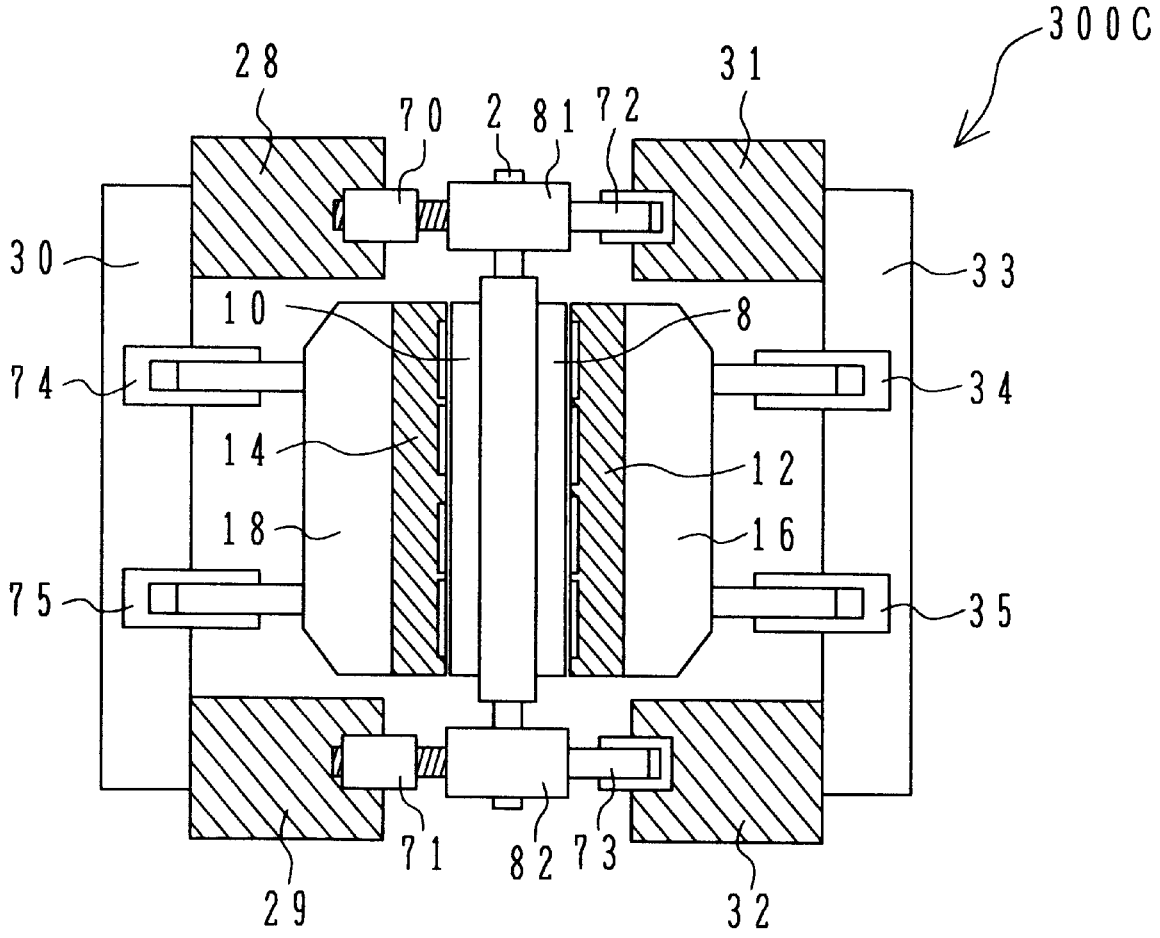
FIG. 27 shows a modification in which work roll chocks are provided to hold the gap between a hydrostatic pressure bearing and the idler roll at a predetermined value.

While in the above-described third embodiment the gap restraining rolls 23–26 serving as the stopper means are provided to prevent the gaps between the hydrostatic pressure bearings 12–15 and the idler rolls 8–11 from becoming smaller than the predetermined value set beforehand, the present invention is not limited to that arrangement. Specifically, as with the structures shown in FIGS. 15 and 16 as modifications of the first embodiment, the third embodiment may further include holding means for holding the gaps between the hydrostatic pressure bearings and the support rolls supported by the hydrostatic pressure bearings at a predetermined value. Such a modification is shown in FIG. 27. Common parts to those in FIGS. 24 and 25 are denoted by the same numerals, and are not described here.

Referring to FIG. 27, work roll chocks 81, 82 for rotatably supporting the upper work roll 2, for example, are provided in a rolling mill 300C at both axial ends of the upper work roll 2. The positions of the chocks 81, 82 are movable by the work-roll moving devices 70, 71 mounted respectively to the housing posts 28, 29 and the hydraulic cylinders 72, 73 mounted respectively to the housing posts 31, 32. Additionally, in this modification, the gaps between the hydrostatic pressure bearings 12, 14, etc. and the idler rolls 8, 10, etc. are also adjusted by the hydraulic cylinders 34, 35, 74, 75, etc.

In the above arrangement, the work-roll moving devices 70, 71 and the hydraulic cylinders 72, 73 constitute chock advancing/retracting means for moving the chocks back and forth with respect to the housing.

This modification can also provide similar advantages as obtainable with the third embodiment.

While in the third embodiment the work roll 2, etc. are disposed substantially at the center of the rolling mill, primarily aiming to prevent contact between the hydrostatic pressure bearings 14, etc. and the idler rolls 10, etc. due to generation of the transient horizontal forces immediately after the start of the rolling, the present invention is not limited to that arrangement. As with the modification of the first embodiment described above in connection with FIG. 19, the third embodiment may also be combined with the well-known offset control for suppressing horizontal deflections of the rolls due to horizontal forces occurred during the rolling operation immediately after the start thereof. Such a case will be described below as a fourth embodiment.

The fourth embodiment of the present invention will be described with reference to FIGS. 28 to 33.

Figure 28:
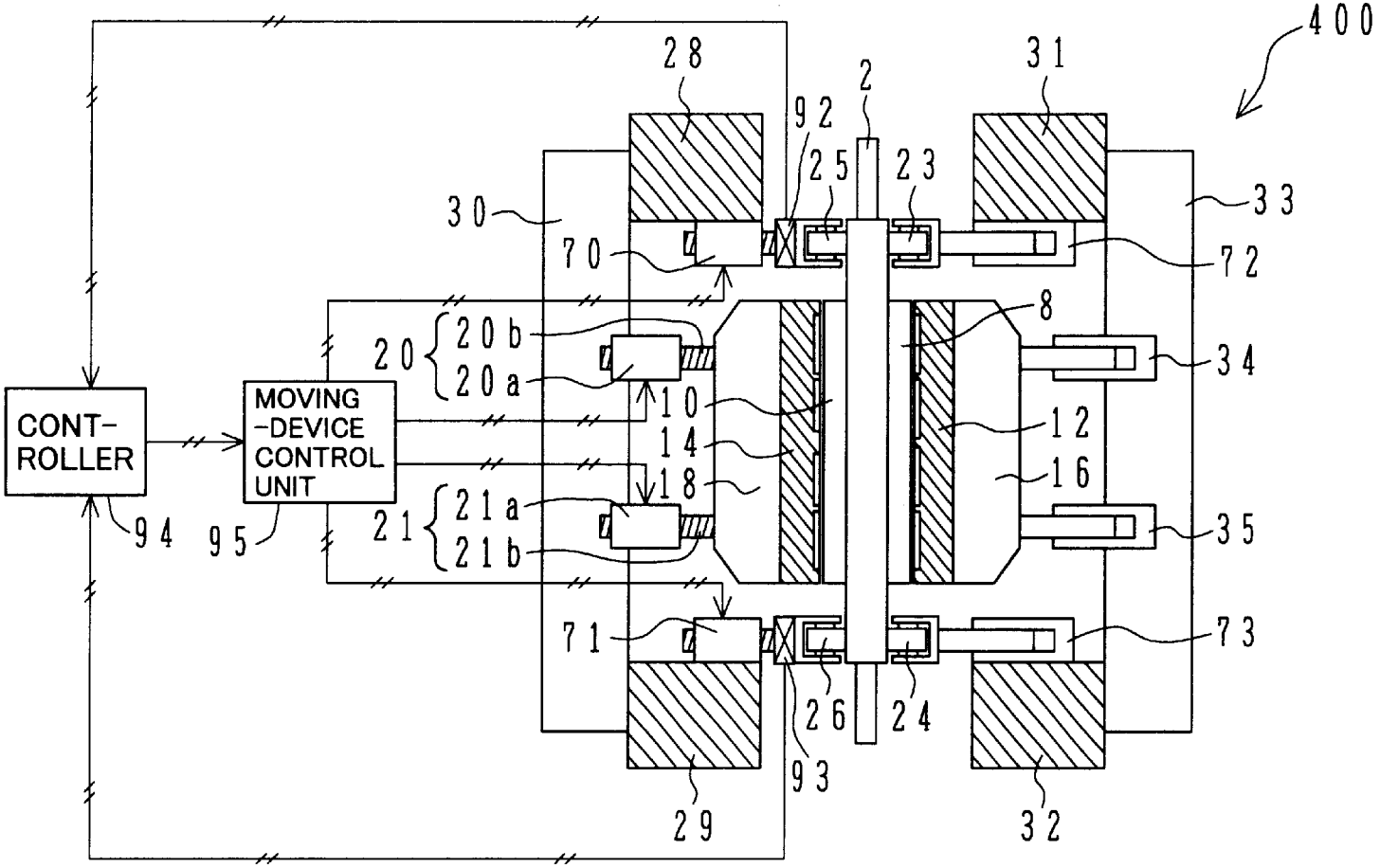
FIG. 28 is a horizontal sectional view of a portion of a rolling mill, including an upper work roll, according to a fourth embodiment of the present invention.

FIG. 28 is a horizontal sectional view of a portion of a rolling mill 400, including an upper work roll, according to the fourth embodiment. Common parts to those in the third embodiment are denoted by the same numerals, and are not described here. The rolling mill 400 according to the fourth embodiment differs from the rolling mill 300 according to the third embodiment in that when a work roll 2, for example, is moved by the work-roll moving devices 70, 71 to the predetermined offset position described above in connection with FIG. 19, loads of the gap restraining rolls 23–26 bearing the horizontal force applied to the work roll 2 at that time are detected by load cells 92, 93 disposed on the back side of the gap restraining rolls 25, 26. The respective forces detected by the load cells 92, 93 are summed by a controller 94 to determine a horizontal force SL. The offset position of the work roll 2 is then feedback controlled by a moving-device control unit 95 so that the horizontal force SL is zero. Simultaneously, since the hydrostatic-pressure-bearing moving devices 20, 21 must be also moved by the same amount, the moving-device control unit 95 outputs the same signal to the hydrostatic-pressure-bearing moving devices 20, 21 as well.

The setting position of the work roll corresponding to the offset amount y in carrying out the above feedback control can be calculated from the formula (4) based on the estimated rolling load P, tensions Tf and Tb, etc.

This fourth embodiment can also provide similar advantages as obtainable with the third embodiment.

An additional advantage of the fourth embodiment is, as described above in connection with FIG. 19, that the horizontal forces SL' specific to the offset control can be coped with at the start of the rolling to effectively prevent the gaps between the hydrostatic pressure bearings 12, 14, etc. and the idler rolls 8, 10, etc. from becoming smaller than the predetermined value set beforehand.

While in the above-described fourth embodiment, the offset position of the upper work roll 2, for example, is controlled in accordance with the loads detected by the load cells 92, 93, the present invention is not limited to that arrangement, and the control of the offset position may be performed by any other suitable manner. Such a modification is shown in FIG. 29.

Figure 29:
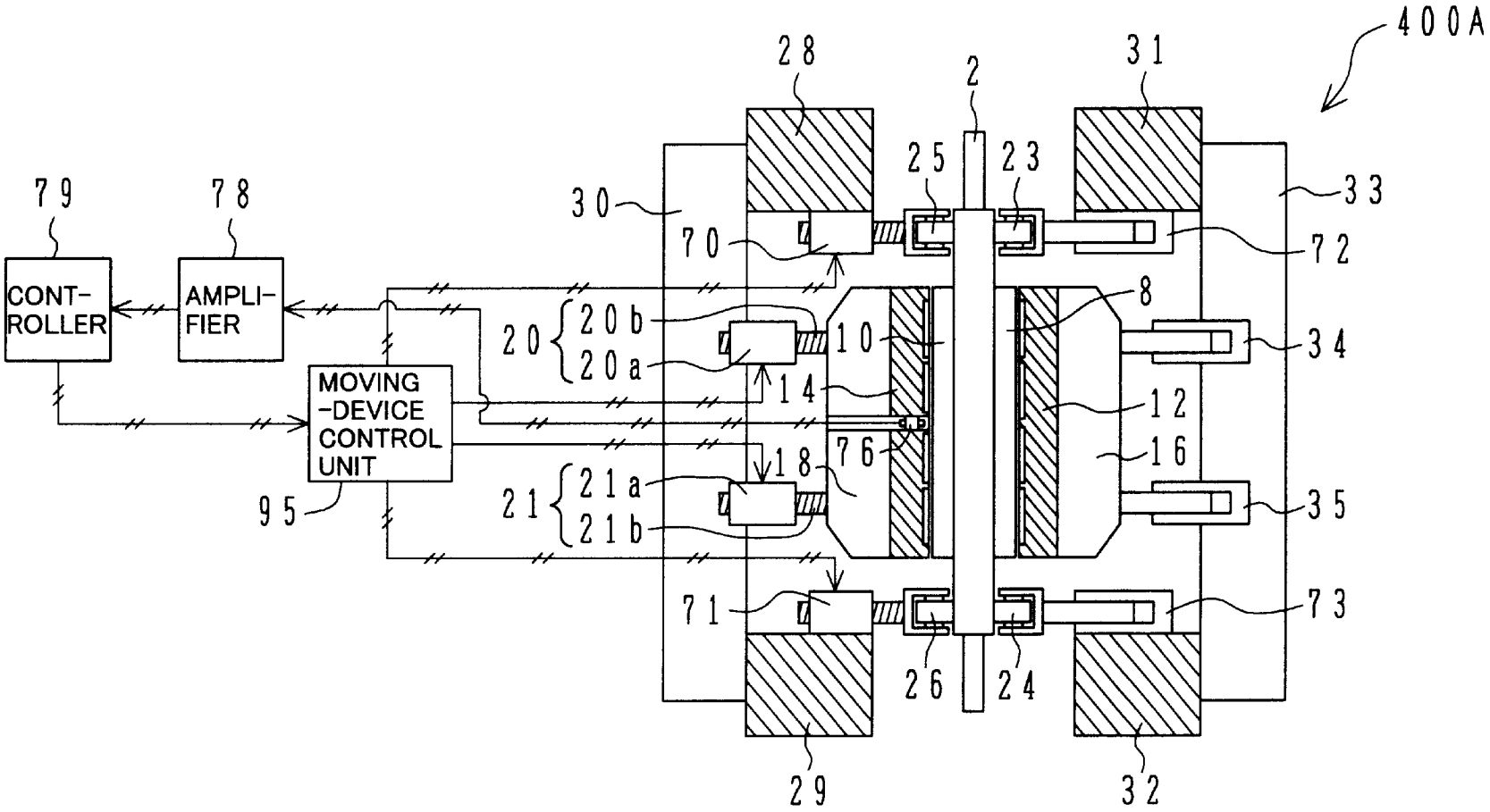
FIG. 29 shows a modification in which an offset position is controlled in accordance with the amount of floating of an idler roll from a hydrostatic pressure bearing.

Referring to FIG. 29, in a rolling mill 400A, the offset position of the upper work roll 2 is controlled in accordance with the amount of floating of the idler roll 10 from the hydrostatic pressure bearing 14, for example. As mentioned before, it is highly possible that changes of the gaps between the idler rolls 10, etc. and the hydrostatic pressure bearings 14, etc. are primarily attributable to horizontal deflections of the work roll 2, etc., but the horizontal deflections are caused by the horizontal forces SL imposed on the work rolls during the rolling. In other words, those gaps should be able to be held constant even during the rolling by controlling the horizontal forces S1 with offset adjustment. The rolling mill 400A of this modification intends to realize such offset adjustment.

More specifically, as with the case of FIG. 26, the gap (floating gap) G between the idler roll 10 and the hydrostatic pressure bearing 14 is detected by the measuring device 76. A detection signal is amplified by the amplifier 78 and then inputted to the controller 79. If G<Gm, the controller 79 determines that the-horizontal force acting leftward in FIG. 29 has increased. Then, the controller 79 outputs control signals to the work-roll moving devices 70, 71 through the moving-device control unit 95, thereby moving the work roll 2 to the right. Simultaneously, the same signals are outputted to the hydrostatic-pressure-bearing moving devices 20, 21 as well. On the other hand, if G>GM, the controller 79 determines that the horizontal force acting rightward in FIG. 29 has increased. Then, the controller 79 causes the work roll 2 to move the left through the moving-device control unit 95 and the work-roll moving devices 70, 71. Simultaneously, the same signals are outputted to the hydrostatic-pressure-bearing moving devices 20, 21 as well.

This modification can also provide similar advantages as obtainable with the above modification of FIG. 28.

In the above-described fourth embodiment, since the offset amount y is a relative value measured between the intermediate roll and the work roll, an equivalent result can also be obtained by moving the intermediate roll in the opposed direction instead of moving the work roll. Such a modification of moving the intermediate roll is shown in FIGS. 30 and 31.

Figure 30:
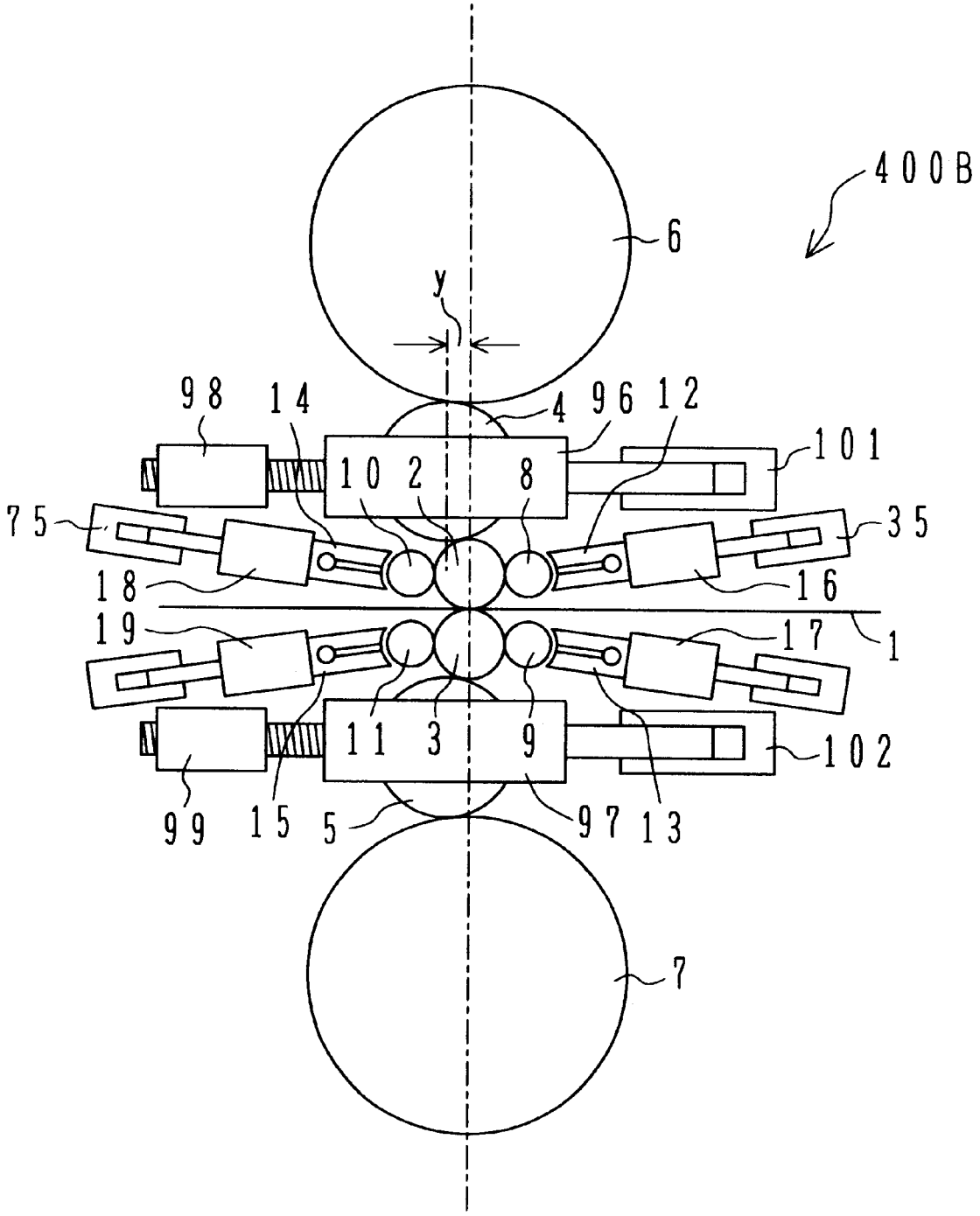
FIG. 30 is a front view showing a schematic structure of a rolling mill according to a modification in which intermediate rolls are offset.
Figure 31:
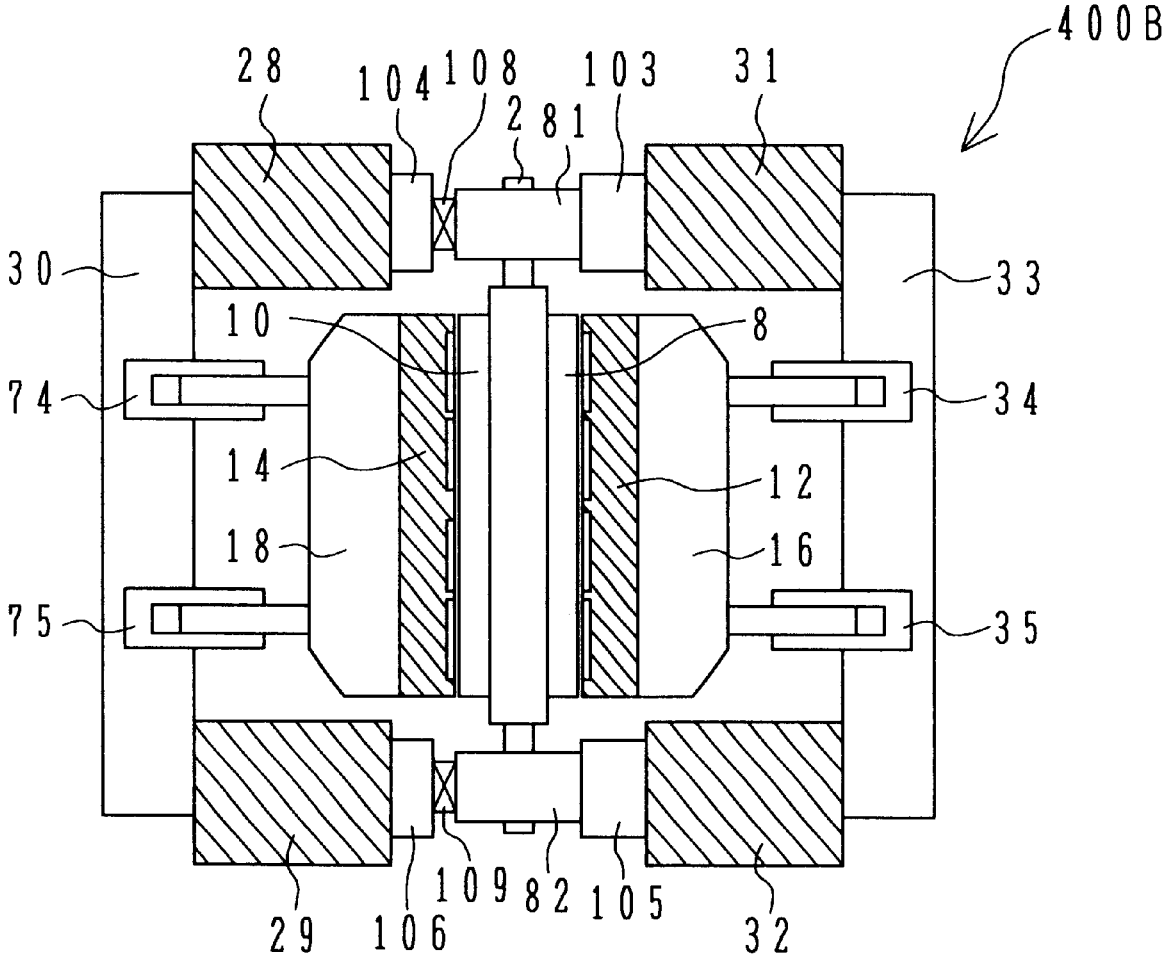
FIG. 31 is a horizontal sectional view of a portion of the rolling mill shown in FIG. 30, including the work roll.

FIG. 30 is a front view showing a schematic structure of a rolling mill 400B according to the modification, and FIG. 31 is a horizontal sectional view of a portion of the rolling mill 400B, including the work roll. Common parts to those in the rolling mills of similar structures, shown in FIGS. 27 and 28, are denoted by the same numerals, and are not described here.

In the rolling mill 400B shown in FIGS. 30 and 31, offset direction moving devices 98, 99 are connected to one sides of intermediate roll chocks 96, 97 for rotatably supporting the intermediate rolls 4, 5, respectively, and hydraulic cylinders 101, 102 are connected to the opposite sides of the intermediate roll chocks 96, 97. The intermediate roll chocks 96, 97 are moved in the offset direction in response to signals outputted from the controller 94, for example, shown in FIG. 28.

On the other hand, the positions of the work roll chocks 81, 82 for supporting the work roll 2, for example, are decided by project blocks 103, 104; 105, 106 mounted respectively to the housing posts 31, 28; 105, 106 so that the work rolls 2, 3 are always held in the same position (usually substantially at the center of the rolling mill). Additionally, load cells 108, 109 for measuring the horizontal forces exerted on the work roll 2 are disposed respectively between the chocks 81, 82 and the project blocks 103, 104, 105, 106.

This modification can provide, in addition to similar advantages as obtainable with the rolling mills shown in FIGS. 28 and 29, another advantage below.

In a single-stand reverse rolling mill, for example, a variety of products, including a thin sheet, must be produced from a plate material having a large thickness by repeating the rolling pass. When a plate material having a large thickness is rolled by work rolls of small diameters, a bite angle is increased. For rendering the work rolls to bite the plate material, the coefficient of friction between the work rolls and the plate material must be not smaller than a value necessary for allowing the increased bite angle. If rolling of the plate material at a large reduction rate is tried, the work rolls cannot bite the plate material sometimes. This means that the use of small-diameter rolls brings about a limit in reduction rate, and deteriorates productivity due to an increase in number of rolling passes required. Accordingly, large-diameter rolls are advantageous when the plate material has a large thickness. On the other hand, when the plate material has a small thickness, the use of large-diameter rolls increases a rolling load, and a larger reduction rate can be obtained with small-diameter rolls. Also, small-diameter rolls can roll a plate having a smaller thickness at minimum than large-diameter rolls. Thus replacement of roll diameters depending on the plate thickness contributes to improving productivity.

In this modification, by using the project blocks 103–106 to which the work roll chocks 81, 82 are mounted, complicated mechanisms such as moving devices and pushing cylinders are no longer required around the work roll chocks 81, 82. This makes it easily possible to replace small-diameter rolls, which require to be supported by hydrostatic pressure bearings, and large-diameter rolls, which usually require to be not supported by hydrostatic pressure bearings, the replacement being necessary from the viewpoint of improving productivity as described above. In this connection, by designing the roll chocks in size such that they can be used in common for both the large- and small-diameter rolls to some extent, the replacement operation can be further facilitated and can be performed in a shorter time.

Although the moving devices 98, 99 and the hydraulic cylinders 101, 102 are still installed around the intermediate roll chocks 96, 97, a larger installation space is left around the intermediate roll chocks 96, 97 than around the work roll chocks 81, 82. Therefore, even those complicated mechanisms can be designed to be easily installed, and do not interfere with the roll replacement operation.

In the above-described fourth embodiment, the hydrostatic pressure bearings 12, 14 are provided on both sides of the upper work roll 2, for example. The present invention is not limited to that arrangement, and either of the hydrostatic pressure bearing may be provided on one side. Such a modification in which the hydrostatic pressure bearing is provided only on one side will be described below with reference to FIG. 32. Common parts to those in the rolling mills including similar structures, shown in FIGS. 27, 28 and 25, are denoted by the same numerals, and are not described here.

Figure 32:
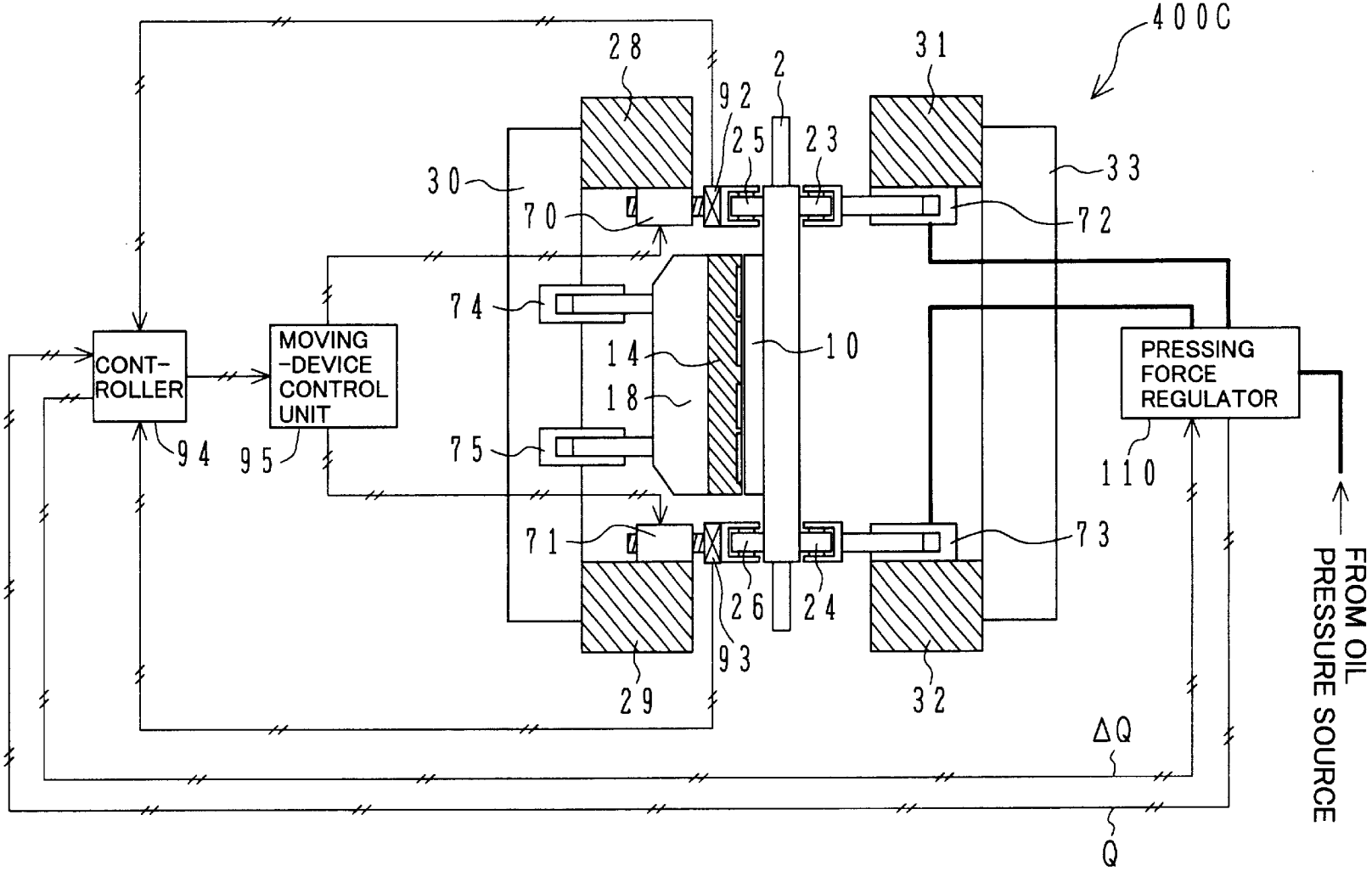
FIG. 32 shows a modification in which a hydrostatic pressure bearing is installed on only one side.

In a rolling mill 400C shown in FIG. 32, as mentioned above, the upper work roll 2, for example, is supported only by the hydrostatic pressure bearing 14 on one side through the idler roll 10. In this case, if the above-described offset position control is performed for the work roll to make the horizontal force SL zero (SL=0), the following drawback would arise. Specifically, if even a slight horizontal force should act on the work roll 2 in the direction toward the side not including the hydrostatic pressure bearing 14 (i.e., the right side in FIG. 32) due to a disturbance, etc. in such a state that a deflection of the work roll 2 is substantially zero under the control for making the horizontal force SL=0, the work roll 2 would undergo a horizontal deflection because there is nothing to support the work roll 2 on that side. Then, if the pressing force Q of the hydraulic cylinders 72, 73 is surpassed by the resulting horizontal force SL, the work roll 2 would spring out.

In this modification, therefore, the controller 94 performs the offset position control for the work roll 2 so that the horizontal force SL acts in the direction toward the hydrostatic pressure bearing 14 (i.e., the left side in FIG. 32) and is held at a predetermined value. As a result, the work roll 2 is always pressed against the hydrostatic pressure bearing 14, and the roll position is stabilized.

In addition, to prevent the work roll 2 from springing out due to abrupt action of a disturbance, the controller 94 also performs control for raising oil pressures of the hydraulic cylinders 72, 73 through a pressing force regulator 110 which includes a hydraulic control valve, thereby increasing the pressing force Q produced by the hydraulic cylinders 72, 73, when the condition of the horizontal force SL<0 is detected.

More specifically, the amount ΔQ of increase of the pressing force Q in the above control is set to, e.g., a value in proportion to an absolute value of the negative horizontal force as given by the following equation:

$$\Delta Q=\alpha|SL| \tag{6}$$

wherein α is a proportional constant.

The amount ΔQ-calculated by the formula (6) is outputted to the pressing force regulator 110, whereupon the amount of oil supplied from the oil pressure source is increased to enlarge the pressing force Q produced by the hydraulic cylinders 72, 73. This control is executed only when the horizontal force SL is negative.

Note that a measured value SLo resulted from the load cells 92, 93 is a value containing the pressing force Q, and the value of Q must be subtracted from the measured value SLo to calculate an accurate horizontal force SL. To this end, the controller 94 also takes in the pressing force Q, i.e., the oil pressures of the hydraulic cylinders 72, 73.

With this modification, only the hydrostatic pressure bearing 14 is installed on one side of the work roll 2, for example, and the equipment cost can be considerably reduced. Another advantage is that since complicated mechanisms such as supporting devices are not provided on the other side, a sufficient space is available for spraying a coolant for cooling the rolls, and the roll cooling efficiency can be improved to achieve speed-up of the rolling and a higher reduction rate.

Figure 33:
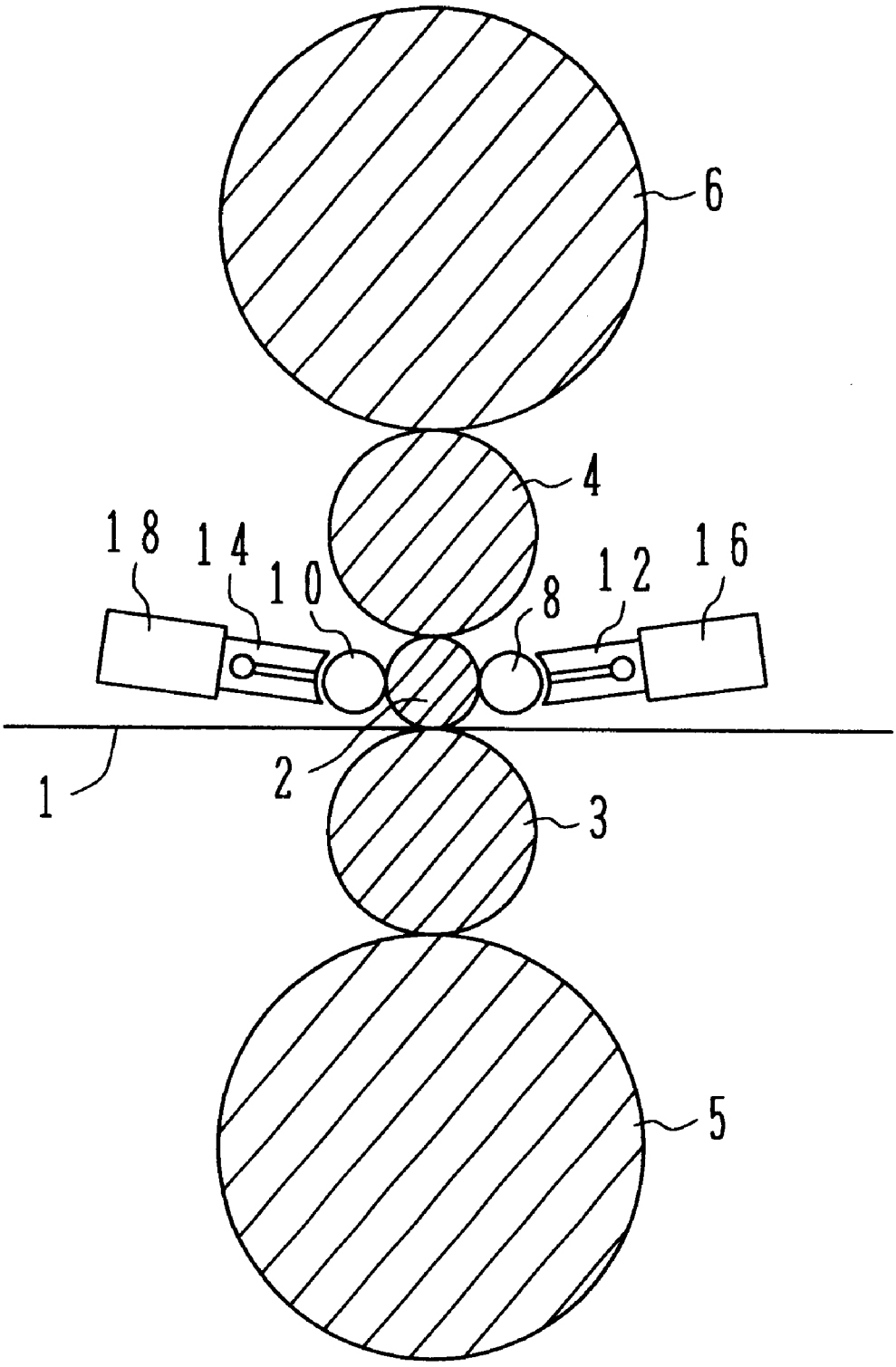
FIG. 33 shows a modification in which the present invention is applied to a 5-high mill being asymmetrical in the vertical direction.

In any of the first to fourth embodiments described above, the present invention is applied to a 6-high mill, but is not limited to the illustrated embodiments. The present invention is also applicable to a general 4-high mill and a 5-high mill (numerals being denoted in conformity with FIG. 2) which is vertically asymmetrical as shown in FIG. 33, for example. These cases can also provide similar advantages as described above.

According to the present invention, even in a transient state immediately before and after the start of the rolling, the distance between the hydrostatic pressure bearing and the work roll can be always ensured so as to sufficiently and surely prevent them from being damaged upon contact with each other. It is hence possible to avoid damage of the work roll, a deterioration of product quality, and a lowering of yield. Further, since damage of the hydrostatic pressure bearing and the work roll is prevented, the operation requires not be suspended for a long time for replacement of those components, and a lowering of productivity can be avoided. Moreover, since work rolls of small diameters can be used in a stable manner, rolling of hard and thin strips can be efficiently performed.

What is claimed is:

1. A plate rolling mill comprising upper and lower work rolls, and hydrostatic pressure bearings for supporting barrel portions of said work rolls or barrel portions of support rolls in a non-contact manner with fluid pressure substantially along the horizontal direction, said support rolls supporting said work rolls substantially along the horizontal direction, wherein:

said plate rolling mill further comprises stopper means for coming into contact with said work rolls or said support rolls when gaps between said hydrostatic pressure bearings and said work rolls or said support rolls supported by said hydrostatic pressure bearings become a predetermined value so as to prevent said gaps from becoming lower than said predetermined value.

2. A plate rolling mill according to claim 1, wherein said stopper means are roller means provided in contact with said work rolls or said support rolls substantially in the horizontal direction.

3. A plate rolling mill according to claim 1, wherein said stopper means are block members fixed to said hydrostatic pressure bearings so as to project toward said work rolls or said support rolls.

4. A plate rolling mill according to claim 1, wherein each of said hydrostatic pressure bearings has an axial width not smaller than a maximum width of plates to be rolled.

5. A plate rolling mill according to claim 1, further comprising detecting means for detecting the gaps between said hydrostatic pressure bearings and said work rolls or said support rolls, and control means for controlling fluid pressures at said hydrostatic pressure bearings in accordance with results detected by the detecting means.

6. A plate rolling mill according to claim 2, wherein said hydrostatic pressure bearings support the barrel portions of said support rolls in a non-contact manner, and said roller means are provided in contact with said work rolls substantially in the horizontal direction.

7. A plate rolling mill according to claim 2, wherein said hydrostatic pressure bearings support the barrel portions of said work rolls in a non-contact manner, and said roller means are provided in contact with said work rolls substantially in the horizontal direction.

8. A plate rolling mill according to claim 2, wherein said hydrostatic pressure bearings support the barrel portions of said support rolls in a non-contact manner, and said roller means are provided in contact with said support rolls substantially in the horizontal direction.

9. A plate rolling mill according to claim 2, wherein each of said roller means is provided in contact with corresponding one of said work rolls or said support rolls at plural points in the vertical direction.

10. A plate rolling mill according to claim 2, wherein said roller means are fixed to beams to which said hydrostatic pressure bearings are connected.

11. A plate rolling mill according to claim 2, wherein said roller means are connected to a housing of said plate rolling mill, and said plate rolling mill further comprises roller advancing/retracting means for moving said roller means back and forth with respect to said housing.

12. A plate rolling mill according to claim 2, wherein said roller means or said block members are in contact with said work rolls or said support rolls at positions axially outside an area corresponding to a maximum width of plates to be rolled.

13. A plate rolling mill according to claim 3, wherein said roller means or said block members are in contact with said work rolls or said support rolls at positions axially outside an area corresponding to a maximum width of plates to be rolled.

14. A plate rolling mill according to claim 6, wherein each of said support rolls includes a first support roll in direct contact with a corresponding one of said work rolls for supporting the same substantially along the horizontal direction, and second support rolls in contact with said first support roll for supporting the same at plural points in the vertical direction, each of said hydrostatic pressure bearings supports the barrel portions of said second support rolls in a non-contact manner, and each of said roller means is provided in contact with said work roll substantially in the horizontal direction.

15. A plate rolling mill comprising upper and lower work rolls, and hydrostatic pressure bearings for supporting barrel portions of said work rolls or barrel portions of support rolls in a non-contact manner with fluid pressure substantially along the horizontal direction, said support rolls supporting said work rolls substantially along the horizontal direction, wherein:

said plate rolling mill further comprises holding means for binding and holding gaps between said hydrostatic pressure bearings and said work rolls or said support rolls supported by said hydrostatic pressure bearings at a predetermined value at all times.

16. A plate rolling mill according to claim 15, wherein said holding means include chocks for rotatably supporting said work rolls or said support rolls.

17. A plate rolling mill according to claim 15, wherein each of said hydrostatic pressure bearings has an axial width not smaller than a maximum width of plates to be rolled.

18. A plate rolling mill according to claim 15, further comprising detecting means for detecting the gaps between said hydrostatic pressure bearings and said work rolls or said support rolls, and control means for controlling fluid pressures at said hydrostatic pressure bearings in accordance with results detected by the detecting means.

19. A plate rolling mill according to claim 13, wherein said chocks are connected to beams to which said hydrostatic pressure bearings are fixed.

20. A plate rolling mill according to claim 16, wherein said chocks are connected to a housing of said plate rolling mill, and said plate rolling mill further comprises chock advancing/retracting means for moving said chocks back and forth with respect to said housing.

21. A plate rolling mill comprising:

upper and lower work rolls for rolling a plate, support rolls for supporting said work rolls substantially along the horizontal direction, hydrostatic pressure bearings for supporting barrel portions of said support rolls with fluid pressure substantially along the horizontal direction, detecting devices for detecting gaps between said hydrostatic pressure bearings and said work rolls or said support rolls, and a control unit for controlling fluid pressures at said hydrostatic pressure bearings in accordance with values detected by said detecting devices.

22. A rolling method comprising the steps of:

supporting upper and lower work rolls for rolling a plate by support rolls substantially along the horizontal direction, supporting barrel portions of said support rolls with fluid pressure substantially along the horizontal direction under supply of a fluid, detecting gaps between said hydrostatic pressure bearings and said work rolls or said support rolls, and controlling fluid pressures at said hydrostatic pressure bearings in accordance with detected gap values.

* * * * *